US009905348B2

(12) United States Patent
Kim

(10) Patent No.: US 9,905,348 B2
(45) Date of Patent: Feb. 27, 2018

(54) ELECTROMAGNETIC OPERATING DEVICE

(71) Applicant: Mitsubishi Electric Corporation, Chiyoda-ku, Tokyo (JP)

(72) Inventor: Taehyun Kim, Chiyoda-ku, Tokyo (JP)

(73) Assignee: MITSUBISHI ELECTRIC CORPORATION, Chiyoda-ku, Tokyo (JP)

( * ) Notice: Subject to any disclaimer, the term of this patent is extended or adjusted under 35 U.S.C. 154(b) by 307 days.

(21) Appl. No.: 14/766,679

(22) PCT Filed: Feb. 28, 2014

(86) PCT No.: PCT/JP2014/055020
§ 371 (c)(1),
(2) Date: Aug. 7, 2015

(87) PCT Pub. No.: WO2014/141901
PCT Pub. Date: Sep. 18, 2014

(65) Prior Publication Data

US 2015/0371748 A1 Dec. 24, 2015

(30) Foreign Application Priority Data

Mar. 13, 2013 (JP) ..... 2013-049839
Mar. 26, 2013 (JP) ..... 2013-063843
May 7, 2013 (JP) ..... 2013-097433

(51) Int. Cl.
*H01F 7/18* (2006.01)
*H01H 47/22* (2006.01)
(Continued)

(52) U.S. Cl.
CPC ..... *H01F 7/18* (2013.01); *H01F 7/064* (2013.01); *H01F 7/081* (2013.01);
(Continued)

(58) Field of Classification Search
CPC ..... H01F 7/18; H01F 7/081; H01H 47/22
(Continued)

(56) References Cited

U.S. PATENT DOCUMENTS

2002/0093408 A1 7/2002 Morita et al.
2004/0164828 A1 8/2004 Morita et al.
(Continued)

FOREIGN PATENT DOCUMENTS

CN 102804306 A 11/2012
DE 102008018260 A1 10/2009
(Continued)

OTHER PUBLICATIONS

Office Action dated Feb. 20, 2017, by the Chinese Patent Office in corresponding Chinese Patent Application No. 201480014444.9 and English translation of the Office Action. (12 pages).
(Continued)

*Primary Examiner* — Dharti Patel
(74) *Attorney, Agent, or Firm* — Buchanan Ingersoll & Rooney PC

(57) ABSTRACT

In the electromagnetic operating device, the driving power supply is composed of two types of power supplies: a capacitor power supply serving as a power supply which is for performing opening/closing operation in a normal time with respect to the vacuum valve; and a DC power supply which is for performing opening/closing operation in an emergency. The capacitor power supply which is for performing opening/closing operation in the normal time includes: capacitors that store electric power to be supplied to the electromagnetic coil; and a control board which controls a current to be supplied from the capacitors to the electromagnetic coil in response to an open-contact or close-contact command to the vacuum valve. Then, the DC power supply which is for performing opening/closing operation in the emergency is to directly supply DC electric power to the electromagnetic coil.

14 Claims, 19 Drawing Sheets

(51) Int. Cl.

| | |
|---|---|
| ***H01H 47/32*** | (2006.01) |
| ***H01H 33/666*** | (2006.01) |
| ***H01F 7/06*** | (2006.01) |
| ***H01F 7/08*** | (2006.01) |
| *H01H 33/59* | (2006.01) |
| *H01H 50/22* | (2006.01) |

(52) U.S. Cl.
CPC ..... *H01H 33/6662* (2013.01); *H01H 47/22* (2013.01); *H01F 2007/086* (2013.01); *H01H 33/59* (2013.01); *H01H 50/22* (2013.01)

(58) Field of Classification Search
USPC ..... 361/190
See application file for complete search history.

(56) References Cited

U.S. PATENT DOCUMENTS

| | | | | |
|---|---|---|---|---|
| 2004/0217834 | A1 | 11/2004 | Morita et al. | |
| 2005/0041590 | A1* | 2/2005 | Olakangil | H04L 45/00 370/238 |
| 2006/0208841 | A1 | 9/2006 | Morita et al. | |
| 2009/0284334 | A1 | 11/2009 | Kim et al. | |
| 2013/0015712 | A1 | 1/2013 | Usai et al. | |

FOREIGN PATENT DOCUMENTS

| | | | | |
|---|---|---|---|---|
| EP | 1 416 503 | A2 | | 5/2004 |
| EP | 1416503 | A2 | | 5/2004 |
| JP | 8-064057 | A | | 3/1996 |
| JP | 11-062677 | | | 3/1999 |
| JP | 2001-248750 | A | | 3/1999 |
| JP | 2004-152628 | | * | 5/2004 |
| JP | 2004-152628 | A | | 5/2004 |
| JP | 2006-222438 | A | | 8/2006 |
| JP | 2012-238505 | A | | 12/2012 |
| WO | 2008-038421 | A1 | | 4/2008 |

OTHER PUBLICATIONS

The extended European Search Report dated Nov. 7, 2016, by the European Patent Office in corresponding European Application No. 14763101.4. (7 pages).

International Search Report (PCT/ISA/210) dated Jun. 10, 2014, by the Japanese Patent Office as the International Searching Authority for International Application No. PCT/JP2014/055020.

* cited by examiner

ELECTROMAGNETIC OPERATING DEVICE

TECHNICAL FIELD

The present invention relates to an electromagnetic operating device used as an operating mechanism of a switch device such as a circuit breaker. Furthermore, the present invention relates to an electromagnet device utilized for an operating mechanism of a switch device such as a circuit breaker and a switch device using the electromagnet device.

BACKGROUND ART

Generally, driving of an electromagnetic operating device is configured such that a capacitor that stores electric power which is for exciting an electromagnetic coil of an electromagnet and a control board that controls the energization direction of a current to be supplied from the capacitor to the electromagnetic coil in response to a closing command or a command of opening contacts (hereinafter, referred to as an "open-contact command") to a switch device are provided, a movable core is driven by exciting the electromagnetic coil by the electric power stored in the capacitor to open or close contacts of the switch device by the driving force of the movable core.

As the conventional electromagnetic operating device equipped with a circuit that operates the switch device by the control board, there is disclosed a configuration which is equipped with, for example, an alternating current (AC)/direct current (DC) converter, a charging circuit, a control logic portion, and a discharging circuit; the discharging circuit has a field effect transistor (FET), a relay contact, and the like as a main control means; and the capacitor is connected to the electromagnetic coil. Opening/closing operation of the switch device is performed by energization to the electromagnetic coil; and opening/closing is controlled by an energization direction to the electromagnetic coil. Electric power charged to the capacitor through the charging circuit is energized to the electromagnetic coil; the energization direction is controlled by the relay contact; and ON/OFF of the energization to the electromagnetic coil is controlled by ON/OFF of the FET (for example, see Patent Document 1).

Furthermore, in an electromagnet device for use in the conventional switch device, a movable portion of the electromagnet device is composed of: a non-magnetic driving shaft that passes through the center of an opening of flat plates provided on both ends in a movable direction; a columnar movable core serving as a magnetic substance of bulk (mass) fixed by being fitted onto the driving shaft; and a disk movable core serving as a magnetic substance, which is arranged on the upper side of the magnetic substance via a thin sheet serving as a magnetic member and is fixed to the driving shaft. The columnar movable core and the disk movable core are fixed to the driving shaft by screwing or a stopper. A fixing process is applied to the driving shaft and an outer diameter dimension is different according to a position. A fixed core is configured by a steel pipe, a flat plate, and a cylinder (for example, see Patent Document 2).

Moreover, in order to protect facilities by instantaneously interrupting a short-circuit fault current and/or an abnormal current, the switch device is used for electric facilities and electric power facilities.

There are disclosed an electromagnet device and a switch device using the electromagnet device in order to prolong the life thereof and to save spaces, the electromagnet device including: an electromagnet which is excited during closing contacts (hereinafter, referred to as "during close-contact") to operate a movable core; a driving shaft which is fixed by passing through the movable core and whose lower end is coupled to the other end of a spindle lever; an open-contact spring which is provided on the upper end of the driving shaft and biases the driving shaft in an interruption direction; and a cushioning device which is provided on an upper part of the driving shaft and with which the upper end of the driving shaft during close-contact comes in contact (for example, see Patent Document 3).

PRIOR ART DOCUMENT

Patent Document

Patent Document 1: JP-A-2004-152628 (Pages 11 and 12, FIG. 10)

Patent Document 2: JP-A-2006-222438

Patent Document 3: JP-A-H8-64057 (Paragraphs [0009] to [0015], FIG. 1)

SUMMARY OF THE INVENTION

Problems to be Solved by the Invention

In the electromagnetic control device (electromagnetic operating device) operated by the control board and the electromagnetic coil as shown in Patent Document 1, a large number of components such as a semiconductor element and a switching relay are used in the control board portion and the number of components is increased; and accordingly, failure probabilities of the semiconductor element and the respective components are accumulated to become higher in failure probability of the entire electromagnetic operating device. As a result, a problem exists in that reliability of the switch device which is opening/closing-driven by the electromagnetic operating device is deteriorated.

In the switch device using the electromagnet device as shown in the aforementioned conventional Patent Document 2, the electromagnet device is manufactured by designing: the columnar movable core; the disk movable core; the driving shaft; and the steel pipe, the flat plate, and the cylinder of the fixed core according to operating force necessary for the switch device of each rating with respect to a plurality of ratings. Accordingly, a problem exists in that standardization of the components of the electromagnet device cannot be achieved.

In the disclosed invention of Patent Document 3, the cushioning device which is for reducing impacts on the close-contact side is provided on the upper side of the driving shaft; and accordingly, a problem exists in that the entire device cannot be reduced in size.

The present invention has been made to solve the above described problem, and an object of the present invention is to provide an electromagnetic operating device that enhances reliability by a simple configuration.

Another object of the present invention is to reduce costs in an electromagnet device by standardizing the shape of a movable core and a fixed core with respect to a plurality of ratings and to reduce in size of the whole of a switch device using the electromagnet device.

A further object of the present invention is to provide an electromagnet device which is equipped with a cushioning device that reduces impacts during the completion of close-contact and open-contact operation and to achieve a reduction in size of the entire device.

Means for Solving the Problems

According to the present invention, there is provided an electromagnetic operating device including: a fixed core; a movable core movably configured with respect to the fixed core; an electromagnetic coil which moves the movable core by excitation to open or close a switch device coupled to the movable core; and a driving power supply that supplies electric power to the electromagnetic coil. The driving power supply is composed of: a capacitor power supply which performs opening/closing operation of the switch device in a normal time, and has a capacitor that stores electric power to be supplied to the electromagnetic coil and a control board that controls a current to be supplied from the capacitor to the electromagnetic coil in response to an open-contact or close-contact command to the switch device; and a DC power supply which performs opening/closing operation of the switch device in an emergency at which the capacitor power supply does not operate and directly supplies DC electric power to the electromagnetic coil. The electromagnetic operating device includes switching means which switches between a circuit to be connected from the capacitor power supply to the electromagnetic coil and a circuit to be connected from the DC power supply to the electromagnetic coil. Then, the switching means is attachably and detachably connected by the connecting means inserted in the middle of the circuit to be connected from the capacitor power supply to the electromagnetic coil, and switches from the circuit on the capacitor power supply side to the circuit on the DC power supply side in the emergency at which the capacitor power supply does not operate.

According to the present invention, there is provided an electromagnet device including: a fixed core configured by laminating a plurality of magnetic substance sheets; a movable core which is configured by laminating a plurality of magnetic substance sheets and moves backward and forward in the fixed core; an electromagnetic coil provided on the fixed core; and a driving shaft arranged in a central portion of the movable core. The driving shaft passes through a central portion of the movable core and is configured as one shaft body coupled to the movable core by a coupling member on a connection portion of the movable core; and the shaft diameter of the connection portion of the driving shaft has a shaft diameter different from the shaft diameter of other portion of the driving shaft.

Furthermore, in a switch device including: a switch main body portion having a fixed contact and a movable contact capable of being connected to and separated from the fixed contact; and an electromagnet device which is coupled to the movable contact of the switch main body portion via a coupling device and makes the movable contact connect to and separate from the fixed contact, the electromagnet device uses the electromagnet device as set forth in the above-mentioned means.

Moreover, according to the present invention, there is provided an electromagnet device including: a fixed core; a movable core arranged in face-to-face relation to the fixed core; a driving shaft fixed by passing through the movable core; an electromagnetic coil that displaces the movable core along the center axis of the driving shaft by flowing a current; an isolating spring to be biased to displace the movable core in a direction to be separated from the fixed core along the center axis of the driving shaft; and a cushioning device that reduces impacts during the completion of the displacement of the movable core. The cushioning device is of a structure in which a cushioning body portion is provided on the driving shaft and a cushioning chamber to be fitted to the cushioning body portion is provided.

In addition, according to the present invention, there is provided an electromagnet device including: a fixed core; a movable core arranged in face-to-face relation to the fixed core; a driving shaft fixed by passing through the movable core; an electromagnetic coil that displaces the movable core along the center axis of the driving shaft by flowing a current; an isolating spring to be biased to displace the movable core in a direction to be separated from the fixed core along the center axis of the driving shaft; and a plurality of cushioning devices that reduce impacts during the completion of the displacement of the movable core. The cushioning device is of a structure in which a cushioning body portion is provided on a cushioning device shaft; a cushioning chamber to be fitted to the cushioning body portion is provided; and the cushioning device shaft is coupled to the movable core.

Advantageous Effect of the Invention

According to the electromagnetic operating device according to the present invention, the driving power supply that supplies electric power to the electromagnetic coil is composed of two types of power supplies: a power supply which is for performing opening/closing operation in the normal time with respect to the switch device; and a power supply which is for performing opening/closing operation in the emergency, whereby even when the power supply which is for performing opening/closing operation in the normal time has an operational defect for some causes, opening/closing operation of the switch device can be performed by the power supply which is for performing opening/closing operation in the emergency and therefore reliability of the electromagnetic operating device is considerably improved.

Furthermore, according to the electromagnet device according to the present invention, a reduction in cost can be achieved by standardizing the shape of the movable core and the fixed core with respect to a plurality of ratings and the entire switch device using the electromagnet device can be reduced in size.

Moreover, the electromagnet device according to the present invention is of the above-mentioned structure, whereby the cushioning device which reduces impacts during the completion of close-contact and open-contact operation can be provided and there has an effect that the entire device can be reduced in size.

In addition, the electromagnet device according to the present invention is of the above-mentioned structure, whereby the cushioning device which reduces impacts during the completion of close-contact and open-contact operation can be provided and there has an effect that the entire device can be reduced in size.

MODE FOR CARRYING OUT THE INVENTION

Embodiment 1

Figure 1:
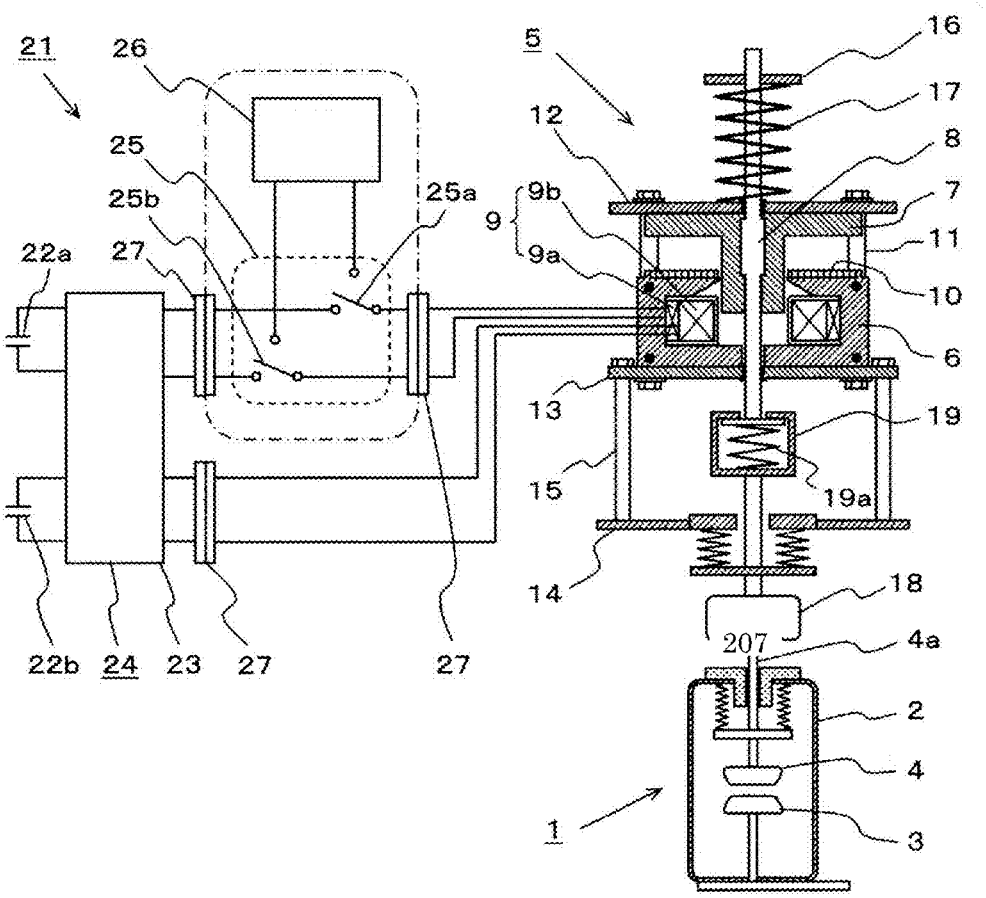
FIG. 1 is an entire configuration view showing an electromagnetic operating device and a switch device to be operated by the electromagnetic operating device, according to Embodiment 1 of the present invention.

FIG. 1 is an entire configuration view showing an electromagnetic operating device and a switch device to be operated by the electromagnetic operating device, according to Embodiment 1; and an electromagnetic operating portion and the switch device are each shown in cross section.

The electromagnetic operating device is connected to the movable side of the switch device to opening/closing-drive the switch device. The electromagnetic operating device is composed of an electromagnetic operating portion and a driving power supply portion that supplies electric power to the electromagnetic operating portion.

First, a description will be made from the switch device to be driven by the electromagnetic operating device. Hereinafter, an example of the switch device will be described by exemplifying a vacuum valve.

A vacuum valve 1 is configured such that a fixed contact 3 and a movable contact 4 are incorporated in the inside of an insulation container 2 and one end of a movable electrode rod 4*a* fixed to the movable contact 4 is led out from the insulation container 2 to the outside via a bellows. The inside of the insulation container 2 is maintained in vacuum in order to improve arc extinguishing performance between both contacts 3, 4.

Next, the electromagnetic operating portion of the electromagnetic operating device will be described.

An electromagnetic operating portion 5 includes: a fixed core 6; a movable core 7 arranged in face-to-face relation to the fixed core 6; a driving shaft 8 which passes through a central portion of the movable core 7 and is fixed to the movable core 7; an electromagnetic coil 9 which is provided on the fixed core 6 and generates a magnetic field by energization; a permanent magnet 10 provided on the fixed core 6 side; braces 11 that fix the fixed core 6; and an open-contact side plate 12 and a close-contact side plate 13, which are arranged on both ends of the braces 11. The electromagnetic coil 9 has an open-contact coil 9*a* and a close-contact coil 9*b*. The fixed core 6 is sandwiched and fixed by the braces 11; whereas the movable core 7 is separated from the fixed core 6 and is capable of being displaced by being driven together with the driving shaft 8 between a backward movement position (position of FIG. 1) coming in contact with the open-contact side plate 12 and a forward movement position coming in contact with the fixed core 6.

The electromagnetic operating portion 5 is supported to a supporting plate 14 via a mounting member 15. The supporting plate 14 is, for example, a frame that supports the vacuum valve 1, a case provided on the frame, and the like. The mounting member 15 is arranged in a standing condition on the supporting plate 14; the close-contact side plate 13 is fixed to the mounting member 15 by bolt fastening or the like; and the braces 11 are fixed to the close-contact side plate 13.

Furthermore, a spring receiver 16 is fixed on the leading end side of the driving shaft 8 protruded from the open-contact side plate 12 to the outside; and an open-contact spring 17 is inserted between the open-contact side plate 12 and the spring receiver 16. The open-contact spring 17 is, for example, a compressed coil spring and generates elastic repulsive force in an axial direction between the open-contact side plate 12 and the spring receiver 16.

Next, a description will be made on a coupling portion between the driving shaft 8 of the electromagnetic operating portion 5 and the movable electrode rod 4*a* of the vacuum valve 1. The coupling portion includes: an insulation rod 18 coupled to the movable electrode rod 4*a*; and a contact pressure device 19 interposed between the insulation rod 18 and the driving shaft 8. The drawing shows one in which a bellows is provided at a portion in which the insulation rod 18 passes through the supporting plate 14; however, there are also cases where the bellows is unnecessary according to the configuration of the supporting plate 14.

Furthermore, the drawing shows one in which an axis line of a driving shaft 8 and an axis line of the vacuum valve 1 are arranged in a straight line; however, a configuration may also be such that the directions of both axis lines are converted by interposing a lever or the like in the coupling portion.

Incidentally, the configuration of the vacuum valve 1 serving as the switch device, the electromagnetic operating portion 5 of the electromagnetic operating device, the contact pressure device 19, and the fixing portion of the electromagnetic operating portion 5, shown in FIG. 1 show one example; and the present invention is not limited to the shape of the drawing.

Next, the operation of the electromagnetic operating portion 5 and the opening/closing operation of the vacuum valve 1 will be briefly described. When the movable contact 4 is in an open-contact state being separated from the fixed contact 3, the movable core 7 is at the backward movement position as shown in FIG. 1 by the biasing force of the open-contact spring 17. When energization is performed to the close-contact coil 9*b* of the electromagnetic coil 9 by a driving power supply (to be described later), the movable core 7 is suctioned to the fixed core 6 and is displaced from the backward movement position toward the forward movement position against a load of the open-contact spring 17. This moves the movable contact 4 of the vacuum valve 1 coupled to the driving shaft 8 toward the fixed contact 3.

After that, when the movable contact 4 comes in contact with the fixed contact 3, the movable contact 4 stops its movement. However, the movable core 7 is further displaced until coming in contact with the fixed core 6 to reach the forward movement position. This shortens a contact pressure spring 19*a* of the contact pressure device 19; and the movable contact 4 is pressed to the fixed contact 3 by a predetermined pressing force to complete close-contact operation.

When the movable core 7 reaches the forward movement position, the movable core 7 is sucked and held by a holding magnetic flux of the permanent magnet 10 to be held at the forward movement position.

In the case of releasing the forward movement position of the movable core 7 from being held to perform open-contact, energization is performed from the driving power supply to the open-contact coil 9*a*; and thus, the suction force between the movable core 7 and the fixed core 6 is lowered and the movable core 7 moves to the backward movement position by each force of the open-contact spring 17 and the contact pressure spring 19*a*.

Next, a description will be made on a driving power supply portion 21 of the electromagnetic operating device, which is a characterizing portion of the present invention. As described before, the electromagnetic coil 9 of the electromagnetic operating portion 5 of the electromagnetic operating device has the open-contact coil 9*a* and the close-contact coil 9*b*.

The driving power supply portion 21 includes: capacitors 22*a*, 22*b* which store electric power to be supplied to the open-contact coil 9*a* and the close-contact coil 9*b* of the electromagnetic coil 9; and a control board 23 which controls a current to be supplied from the capacitors 22*a*, 22*b* to the open-contact coil 9*a* or the close-contact coil 9*b* in response to an open-contact or close-contact command to the vacuum valve 1 serving as the switch device. In a normal time, the electromagnetic operating portion 5 is driven by the power supply; and thus, the vacuum valve 1 is opened or closed. In the following description, the power supply equipped with the capacitors 22*a*, 22*b* and the control board 23 will be referred to as a "capacitor power supply 24."

Further, in the driving power supply portion 21, a DC power supply 26 is connected via switching means 25 to a circuit in which the capacitor power supply 24 and the open-contact coil 9*a* are connected. The switching means 25 is composed of switching switches 25*a*, 25*b* each configured by, for example, a manual push button switch. The DC power supply 26 drives the electromagnetic operating portion 5 to operate the vacuum valve 1 in an emergency. Normally, the DC power supply 26 may utilize a DC power supply equipped for controlling the switch device.

The switching means 25 is incorporated in the circuit by being connected by connecting means 27 inserted in the middle of the circuit in which the control board 23 and the open-contact coil 9*a* are connected. The connecting means 27 is, for example, a generally known connector composed of a plug and a receptacle.

Actually, normally, the control board 23 is connected to the electromagnetic coil 9 via the connecting means 27; and therefore, the connecting means 27 are opened and the switching means 25 having the connector means 27 having the same connecting shape may be inserted therebetween. This permits to connect the DC power supply 26 by subsequently and easily inserting the switching means 25 even to an existing electromagnetic operating device that does not have the DC power supply 26.

As described above, the driving power supply portion 21 of the present invention is composed of two types of power supplies including: the capacitor power supply 24; and the DC power supply 26, as the driving power supply.

Next, the operation of the driving power supply portion 21 will be described.

The capacitors 22*a*, 22*b* are charged by a charging circuit not previously shown in the drawing. The switching means 25 is normally switched to the control board 23 side. A description will be made on the case of performing close-contact from the open-contact state like FIG. 1. When a command of closing contacts (hereinafter, referred to as a "close-contact command") is inputted to the control board 23, electric power stored in the capacitor 22*b* is discharged to the close-contact coil 9*b* by a signal from the control board 23 to energize the close-contact coil 9*b*; and thus, the movable core 7 is suctioned to the fixed core 6 side and both contacts 3, 4 of the vacuum valve 1 are closed and becomes a closing state by the close-contact operation as described before.

In the case of performing open-contact, when the open-contact command is inputted to the control board 23, electric power stored in the capacitor 22*a* is discharged to the open-contact coil 9*a* by a signal from the control board 23 to energize the open-contact coil 9*a*, the suction force between the movable core 7 and the fixed core 6 is lowered, the movable core 7 moves in a direction to be separated from the fixed core 6 by each load of the open-contact spring 17 and the contact pressure spring 19*a*, and both contacts 3, 4 of the vacuum valve 1 are open-contacted.

The above-mentioned opening/closing operation is the opening/closing operation of the vacuum valve 1 in the normal time.

Here, if, in the case where some failure occurs in the control board 23 of the capacitor power supply 24 and open-contact control cannot be performed from the capacitor power supply 24 side, a circuit flowing from the DC power supply 26 to the open-contact coil 9*a* can be secured by switching the switching switches 25*a*, 25*b* of the switching means 25 to the DC power supply 26 side; and the open-contact operation of the electromagnetic operating portion 5 can be performed by energizing to the open-contact coil 9*a* by the DC power supply 26.

As described above, two types of power supplies to be connected to the electromagnetic coil 9 of the electromagnetic operating portion 5, that is, the capacitor power supply 24 and the DC power supply 26 are provided; and thus, even when either the power supply is shut down, the other power supply can be operated. Therefore, reliability of the electromagnetic operating device is improved and reliability of the switch device to be operated by the electromagnetic operating device is improved.

Furthermore, by such a configuration, even when one power supply needs to be replaced, replacement can be easily performed.

Moreover, the circuit on the DC power supply 26 side is considerably small in the number of components constituting an electric circuit as compared to that on the control board 23 side; and therefore, failure probability due to accumulation of the number of components can be considerably reduced and operational reliability of the switch device is considerably improved.

Further, as shown in FIG. 1, there is provided the switching means 25 which is for switching to any of the connections between the electromagnetic operating portion 5 and the power supplies 24 and between the electromagnetic operating portion 5 and the power supply 26; and thus, an interference between the power supplies 24, 26 is blocked and an influence on other power supply circuit can be prevented. The switching means 25 is the manual switching switch; and thus, the switching means can be reduced in cost.

Incidentally, the description has been made on the case where the DC power supply 26 is connected on the open-contact coil 9*a* side of the electromagnetic coil 9 in FIG. 1. In this case, the configuration is such that priority is given to interrupting a current by the switch device by performing open-contact. In this regard, however, the present invention is not limited to this, but the configuration may be such that the DC power supply 26 is connected on the close-contact coil 9*b* side, and priority is given to conducting the current by the switch device. Furthermore, if the operation of both open-contact and close-contact is duplex by connecting the DC power supply via the switching means to the connection portions with the control board 23 with respect to both of the open-contact side and the close-contact side, reliability can be further improved.

Further, the connecting means 27 by which the switching means 25 is inserted between the electromagnetic operating portion 5 and the control board 23 are provided; and thus, a change to the configuration of the present invention can be easily made by connecting the circuit shown in a dashed-dotted line of FIG. 1 to, for example, the electromagnetic operating device having the existing electromagnetic operating portion and the power supply including the capacitors and the control board. A modification period and a power failure time can be shortened; and therefore, a rate of operation time of an apparatus connected on the lower stream side of the switch device can be improved.

Incidentally, the description has been made on the case where the electromagnetic coil is composed of the open-contact coil and the close-contact coil in FIG. 1; however, the present invention can also be applied to an electromagnetic operating device which uses one electromagnetic coil and performs opening/closing control by switching an energization direction to the electromagnetic coil.

As described above, according to the electromagnetic operating device of Embodiment 1, the electromagnetic operating device includes: the fixed core; the movable core movably configured with respect to the fixed core; the electromagnetic coil which moves the movable core by excitation to open or close the switch device coupled to the movable core; and the driving power supply that supplies electric power to the electromagnetic coil. The driving power supply is composed of two types of power supplies: the power supply which is for performing opening/closing operation in the normal time with respect to the switch device; and the power supply which is for performing opening/closing operation in an emergency. Thus, even when the power supply which is for performing opening/closing operation in the normal time has an operational defect for some causes, the opening/closing operation of the switch device can be performed by the power supply which is for performing opening/closing operation in the emergency; and therefore, reliability of the electromagnetic operating device is improved.

Furthermore, in the driving power supply, the power supply which is for performing opening/closing operation in the normal time is the capacitor power supply which includes: the capacitor that stores electric power to be supplied to the electromagnetic coil; and the control board that controls the current to be supplied from the capacitor to the electromagnetic coil in response to the open-contact or close-contact command to the switch device. Then, the power supply which is for performing opening/closing operation in the emergency is the DC power supply that directly supplies DC electric power to the electromagnetic coil. Thus, the circuit of the DC power supply can be considerably reduced in the number of constituting components as compared to the capacitor power supply; and therefore, failure probability due to accumulation of the number of components can be considerably reduced and the electromagnetic operating device with high reliability can be provided.

Moreover, the switching means which switches between the circuit to be connected from the capacitor power supply to the electromagnetic coil and the circuit to be connected from the DC power supply to the electromagnetic coil is provided; and therefore, the interference between the capacitor power supply and the DC power supply is prevented and the influence on other power supply circuit can be prevented.

In addition, the switching means is attachably and detachably connected by the connecting means inserted in the middle of the circuit connected from the capacitor power supply to the electromagnetic coil. Thus, modification to the electromagnetic operating device in which the switching means and the DC power supply are easily added with respect to the existing electromagnetic operating device having only the capacitor power supply. Furthermore, replacement can be easily dealt with even when replacement of another power supply is needed.

Embodiment 2

Figure 2:
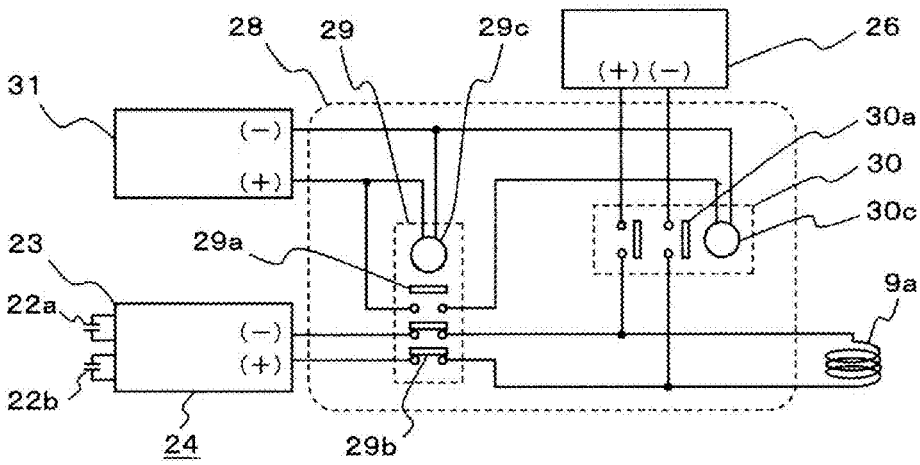
FIG. 2 is a circuit diagram showing a switching means portion of an electromagnetic operating device according to Embodiment 2 of the present invention.

FIG. 2 is a circuit diagram showing the configuration of a switching means portion of an electromagnetic operating device according to Embodiment 2. The entire configuration of the electromagnetic operating device including a capacitor power supply 24, a DC power supply 26, and an electromagnetic operating portion 5 is equivalent to that of FIG. 1 of Embodiment 1; and the portion of the switching means 25 shown by the dashed line of FIG. 1 is configured by switching means 28 shown by a dashed line in FIG. 2. Portions equivalent to those in FIG. 1 are shown by the same reference numerals and their detailed description will be omitted. The switching means 25 of FIG. 1 of Embodiment 1 uses the manual switching switch; however, switching means 28 of this embodiment is electrically-driven.

As shown in FIG. 2, the switching means 28 has a first relay 29 and a second relay 30. A normally closed contact 29*b* of the first relay 29 is connected between the open-contact coil 9*a* of the electromagnetic coil 9 of the electromagnetic operating portion 5 that opens or closes the switch device and the control board 23; and open-contact operation of the vacuum valve 1 serving as the switch device can be performed by energizing from the control board 23 to the open-contact coil 9*a*. Furthermore, the DC power supply 26 is connected to the open-contact coil 9*a* via a normally open contact 30*a* of the second relay 30.

Further, the switching means 28 has input terminals in which an external command 31 is inputted; a circuit from the external command 31 is connected to an operation coil 29*c* of the first relay 29; and a normally open contact 29*a* of the first relay 29 and an operation coil 30*c* of the second relay 30 are connected in series.

By such a configuration, when the switching means 28 receives the external command 31 and energization is started, first, the operation coil 29*c* of the first relay 29 is energized to operate the first relay 29, the normally closed contact 29*b* is opened to separate the circuit between the control board 23 and the open-contact coil 9*a*; the normally open contact 29*a* of the first relay 29 is closed; a current from the external command 31 is energized to the operation coil 30*c* of the second relay 30; the normally open contact 30*a* of the second relay 30 is closed; a circuit between the DC power supply 26 and the open-contact coil 9*a* is connected; energization is performed from the DC power supply 26 to the open-contact coil 9*a* to drive the movable core 7 in an open-contact direction; and the vacuum valve 1 is open-contacted.

Opening/closing operation of the switch device in a normal time is performed from the capacitor power supply 24 side equipped with the capacitors 22*a*, 22*b* and the control board 23. The normally closed contact 29*b* of the first relay 29 is in a connection state during power supply OFF of the first relay 29; and therefore, the first relay 29 does not consume electric power for opening/closing in the normal time and electric power of the electromagnetic operating device can be saved.

When the switch device is operated by the DC power supply 26 in an emergency, the circuit on the side of the control board 23 and the electromagnetic coil 9 is automatically interrupted by inputting the external command 31 and, after that, the DC power supply 26 can be connected to the electromagnetic coil 9 side. As described above, a controlling device does not need to be provided in addition to the switching means 28; and therefore, there is no possibility to erroneously operate a connection destination and an erroneous operation can be prevented. Furthermore, switching can be carried out by an operation time of each relay 29, 30; and therefore, the circuit can be switched in a short time.

FIG. 2 shows the configuration in which the switching means 28 comprised of the relays is connected to the circuit of the open-contact coil 9*a* of the electromagnetic coil 9; however, a configuration may be such that priority is given to conducting a current to the switch device by connecting the DC power supply 26 by providing the switching means 28 on the close-contact coil 9*b* side. Furthermore, the operation of both open-contact and close-contact may be duplex by connecting the DC power supply by providing the switching means 28 on both of the open-contact side and the close-contact side.

Furthermore, as in Embodiment 1, it may be attachably and detachably configured by connecting the portion of the switching means 28 in the middle of the circuit connected between the control board 23 and the electromagnetic coil 9 by using the connecting means 27.

As described above, according to the electromagnetic operating device of Embodiment 2, the switching means has: the first relay which is provided in the middle of the circuit to be connected from the capacitor power supply to the electromagnetic coil and is operated by the external command; and the second relay which is provided in the circuit to be connected from the DC power supply to the electromagnetic coil and is operated by the external command. Thus, opening/closing operation of the switch device can be performed from afar by giving the external command in an emergency; and therefore, reliability of the operation of the electromagnetic operating device is improved.

Furthermore, the first relay has the normally closed contact in which the first relay is ON during energization of the operation coil and is OFF during non-energization thereof, and the capacitor power supply and the electromagnetic coil are connected via the normally closed contact of the first relay. Thus, electric power of the first relay side is not consumed in the electrical connection between the capacitor power supply which is for performing opening/closing operation in the normal time and the electromagnetic coil; and therefore, electric power of the electromagnetic operating device can be saved even in the case of having two types of power supplies.

In addition, the first relay has the normally open contact in addition to the normally closed contact; the second relay has the normally open contact; and the normally open contact of the first relay is connected to the operation coil of the second relay. Then, when the operation coil of the first relay is energized by the external command, the normally closed contact of the first relay is opened; the normally open contact of the first relay is closed; and the normally open contact of the second relay is further closed, whereby supply of electric power to the electromagnetic coil is switched from the capacitor power supply to the DC power supply. Thus, the DC power supply can be connected to the electromagnetic coil after the capacitor power supply is automatically cut off by giving the external command; and therefore, there can be prevented an erroneous operation which erroneously operates a connection destination. Furthermore, switching can be carried out by the operation time of the relays; and therefore, the power supply circuit can be switched in a short time.

Embodiment 3

Figure 3:
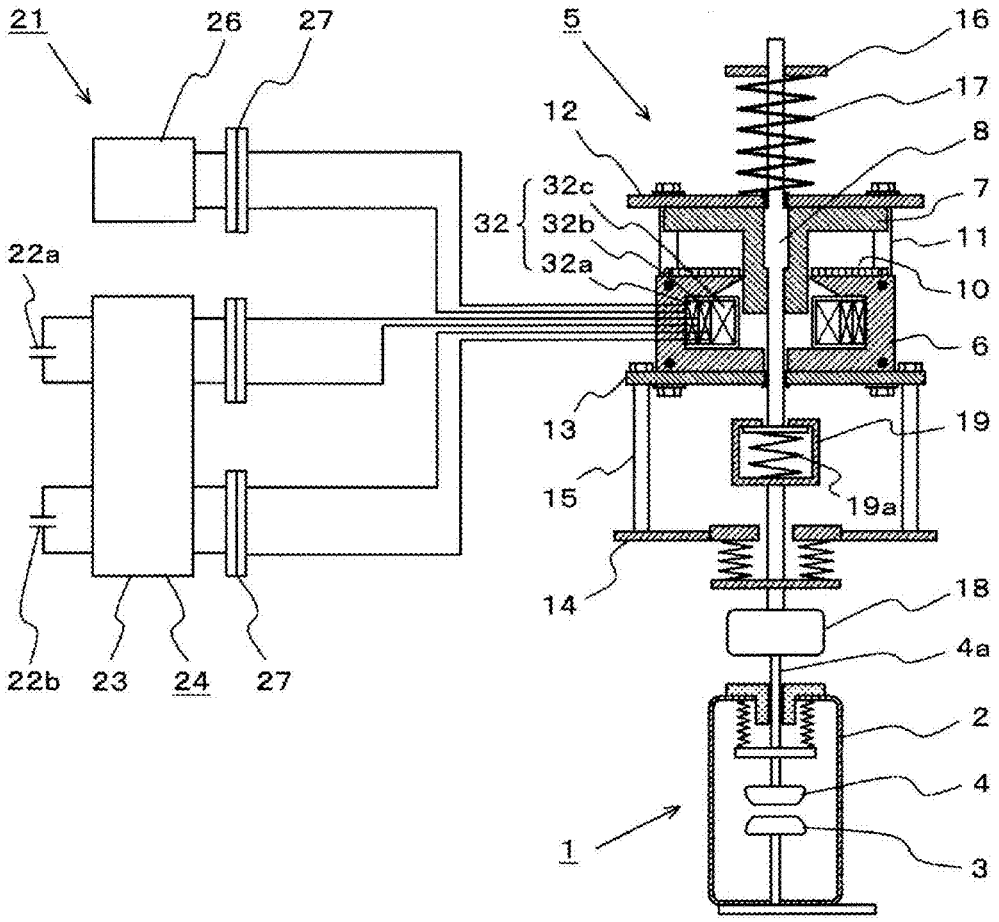
FIG. 3 is an entire configuration view showing an electromagnetic operating device and a switch device to be operated by the electromagnetic operating device, according to Embodiment 3 of the present invention.

FIG. 3 is an entire configuration view showing an electromagnetic operating device and a switch device operated by the electromagnetic operating device, according to Embodiment 3. Portions equivalent to those in FIG. 1 of Embodiment 1 are shown by the same reference numerals and their description will be omitted and a description will be made centering on different points.

In Embodiment 1, for example, when the DC power supply is connected to the open-contact coil side, the capacitor power supply and the DC power supply are switched by using the switching means with respect to one open-contact coil.

On the other hand, in this embodiment, for example, when a power supply of an open-contact coil is a duplex power supply of a capacitor power supply and a DC power supply, an open-contact coil 32*b* to be connected to a capacitor power supply 24 and an open-contact coil 32*a* to be connected to a DC power supply 26 are individually provided as shown in FIG. 3. More specifically, an electromagnetic coil 32 is composed of two open-contact coils 32*a*, 32*b* and a close-contact coil 32*c*.

By such a configuration, in addition to the effect like Embodiment 1 by the duplex power supply, switching means does not need to be provided and probability of failure of the switching circuit can be reduced; and therefore, an improvement in reliability and a reduction in cost can be achieved by a simple configuration.

Furthermore, it is possible to prevent mutual influence between the power supplies of the capacitor power supply 24 and the DC power supply 26. Therefore, means that prevents an influence on other power supply circuit does not need to be provided and a reduction in cost can be achieved.

In addition, each winding of the electromagnetic coil 32 can be appropriately designed in correspondence to each power supply and therefore an electric element that adjusts a circuit constant does not need to be added.

An electromagnetic operating portion 5 can generate electromagnetic force by the product of current and the number of winding turns even in the case of small current energization by increasing the number of winding turns of the electromagnetic coil 32. Therefore, in this configuration, the electromagnet can also be operated by energization with a small current by increasing the number of winding turns of the DC power supply.

Further, in the electromagnetic coil 32 that reciprocates the movable core 7, as winding means that moves in one direction, there can be connected a small-capacity capacitor for a winding with a large number of winding turns and a large-capacity capacitor for a winding with a small number of winding turns. If operation is made by the large-capacity capacitor side in the case of responding at high speed and if operation is made by the small-capacity capacitor side when the circuit on the large capacity capacitor side is not operated, a reduction in size of the capacitor can be achieved. In addition, a current value is small on the small-capacity side; and therefore, an element of the control board may also be small in capacity and the control board can also be reduced in size and in cost.

Incidentally, in FIG. 3, the configuration is such that two open-contact coils are provided and are each connected to a different type power supply, and priority is given to interrupting a current by performing open-contact. The present invention is not limited to this configuration, but a configuration may be such that two close-contact coils are provided and are each connected to a different type power supply, and priority is given to conducting a current by prioritizing close-contact. Furthermore, reliability of both operations of open-contact and close-contact can also be improved by providing two electromagnetic coils on each of both of the open-contact side and the close-contact side.

As described above, according to the electromagnetic operating device according to the Embodiment 3, the electromagnetic coil is individually provided with coils, each of which is connected to each of two types of the power supplies; and therefore, it is possible to prevent an influence on other power supply circuit without the need for means that prevents the influence on other power supply circuit.

Furthermore, switching means can be eliminated as compared to Embodiment 1 or 2 and thus probability of failure can be reduced by just that much; and therefore, reliability can be improved and a reduction in cost can be achieved by a simple configuration.

Embodiment 4

Figure 4:
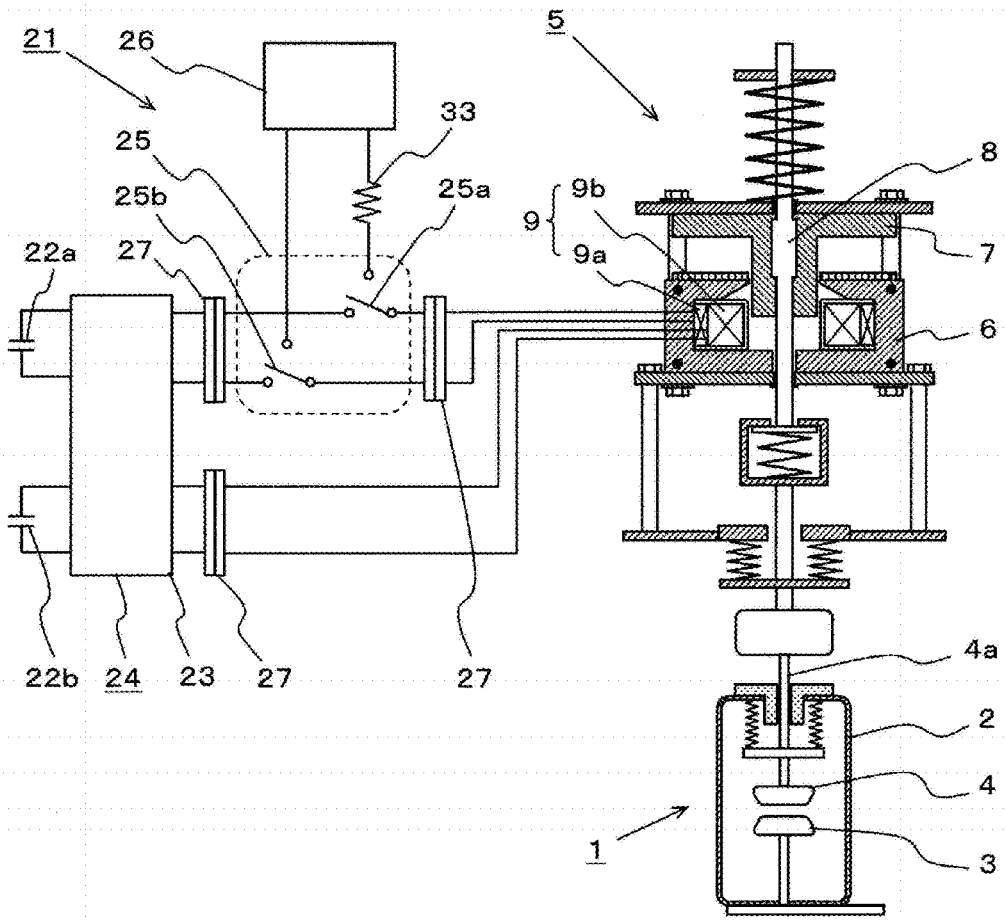
FIG. 4 is an entire configuration view showing an electromagnetic operating device and a switch device to be operated by the electromagnetic operating device, according to Embodiment 4 of the present invention.

FIG. 4 is an entire configuration view showing an electromagnetic operating device and a switch device operated by the electromagnetic operating device according to Embodiment 4. Portions equivalent to those in FIG. 1 of Embodiment 1 are shown by the same reference numerals, their description will be omitted, and a description will be made centering on a different point.

The different point from FIG. 1 is that a resistor 33 is inserted in the middle of a circuit connected between a DC power supply 26 and an open-contact coil 9*a* of an electromagnetic coil 9, more specifically, in the front of a switching switch 25*a*.

The following effects are generated by inserting the resistor 33 on the DC power supply 26 side.

When a plurality of types of power supplies are connected to one electromagnetic coil, the characteristics of the electromagnetic coil are designed to be optimized to the characteristics of any one of the power supplies; and accordingly, there is a case where the characteristics are not matched to that of other power supplies. More particularly, when a DC power supply is added to an electromagnetic operating device equipped with a capacitor power supply at a later time, the characteristics of the electromagnetic coil is optimized to the characteristics of the capacitor power supply and the characteristics of the DC power supply need to be matched with the characteristics of the electromagnetic coil.

So, as shown in FIG. 4, the resistor 33 is inserted in the middle of the circuit in which the DC power supply 26 is connected to the electromagnetic coil 9; and thus, an electric circuit constant can be adjusted and appropriate characteristics can be achieved. For example, a current continuously flows in the DC power supply 26; and accordingly, if no measure is taken, the electromagnetic coil 9 is likely to be burned out due to heat generation caused by a large current. However, the current can be suppressed by inserting the resistor 33, thereby permitting continuous energization.

Figure 5:
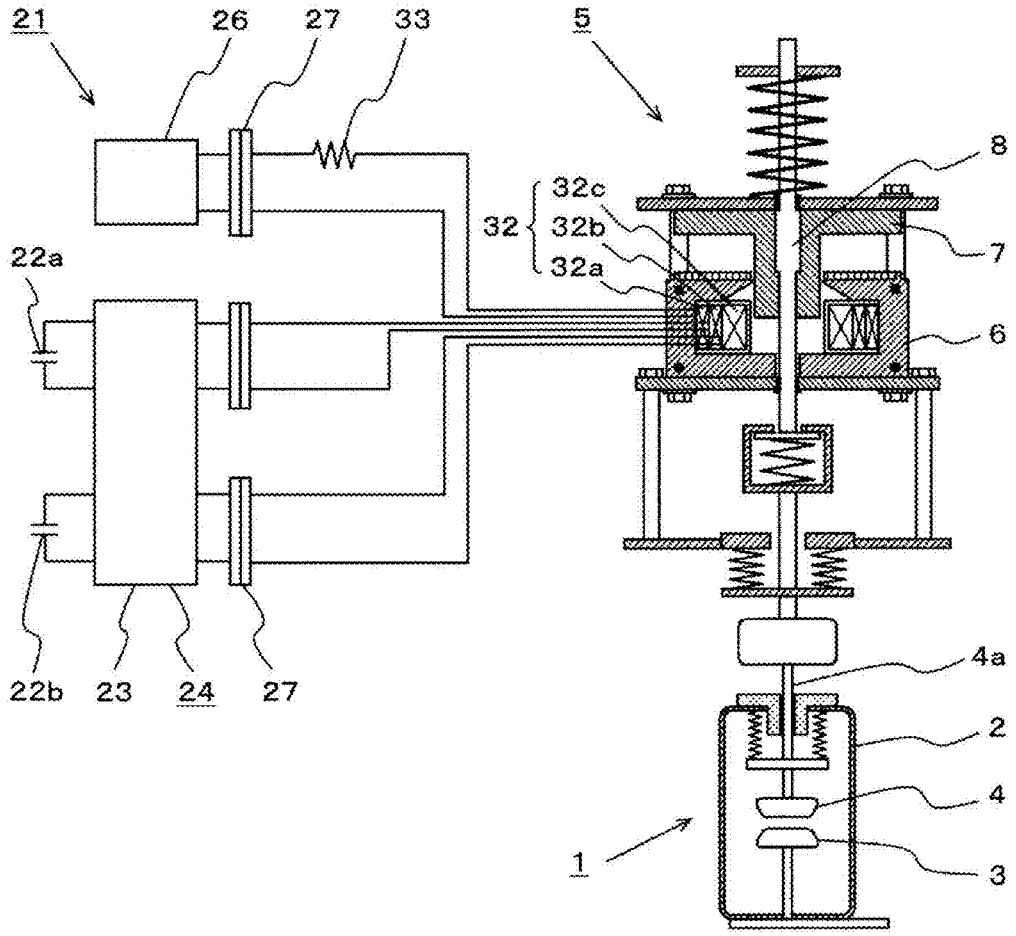
FIG. 5 is an entire configuration view showing other example of an electromagnetic operating device according to Embodiment 4.

FIG. 5 is a view showing other example of a configuration in which a resistor is inserted on the DC power supply side and a resistor 33 is inserted in a circuit equivalent to FIG. 3 of Embodiment 3.

Like FIG. 5, even when individual coils 32*a* to 32*c*, each of which is connected to each power supply, are provided as an electromagnetic coil 32 and each coil 32*a* to 32*c* is optimized to the corresponding power supply, the following effect exists by the connection of the resistor 33.

The effect is that stable operation without depending on an ambient temperature can be achieved. Resistance of copper wire varies with temperature by 0.00393/K. A flowing current value varies depending on the ambient temperature; and accordingly, design is made at a minimum temperature of operation specification at which capacity of the DC power supply 26 becomes a maximum energization current and it becomes excessive specification. So, a substantially constant resistor is mounted irrespective of the temperature and a resistance value of the electromagnetic coil 32 is designed to be small; and thus, the entire change of the resistance value due to the temperature becomes small and an advantage exists in that a current capacity of the DC power supply 26 can be reduced. Furthermore, an energization current value becomes substantially constant; and therefore, the operation of the electromagnetic operating device is stabilized.

Here, if a current flowing in the electromagnetic coil connected to the DC power supply 26 is further adjusted to be equal to or lower than 5 A at a voltage of the DC power supply 26 by the resistor 33, the following effect can be expected.

When a user uses the switch device, a current value to be used is required to be suppressed to 5 A at maximum. When facility update in which the DC power supply is added to the existing electromagnetic operating device is performed, a current value flowing in the DC power supply circuit is set to be equal to or lower than 5 A by adjusting a resistance value of the resistor 33; and thus, the updated facility can be used with compatibility with the conventional switch device and therefore there can be achieved a reduction in cost of facility change without largely changing the facilities in updating.

As described above, according to the electromagnetic operating device of Embodiment 4, the resistor is inserted in the middle of the circuit connected from the DC power supply to the electromagnetic coil. Thus, even in the case of the electromagnetic coil optimized to any one of power supplies, adjustment of the characteristics with other power supplies can be performed by the resistor. Furthermore, the resistor which does not depend on the temperature is arranged; and thus, the operation of the electromagnetic operating device can be suppressed from being influenced by the temperature and stable operation can be achieved.

Furthermore, the resistor is adjusted to be the resistance value at which the current flowing in the circuit to be connected from the DC power supply to the electromagnetic coil is set to be equal to or lower than 5 A. Thus, the current value becomes equal to or lower than a current value of a generally frequently used electromagnetic operating device; and therefore, in the case of updating by adding the DC power supply to the existing facilities, the update can be carried out without a large change of the facilities.

Embodiment 5

Figure 6:
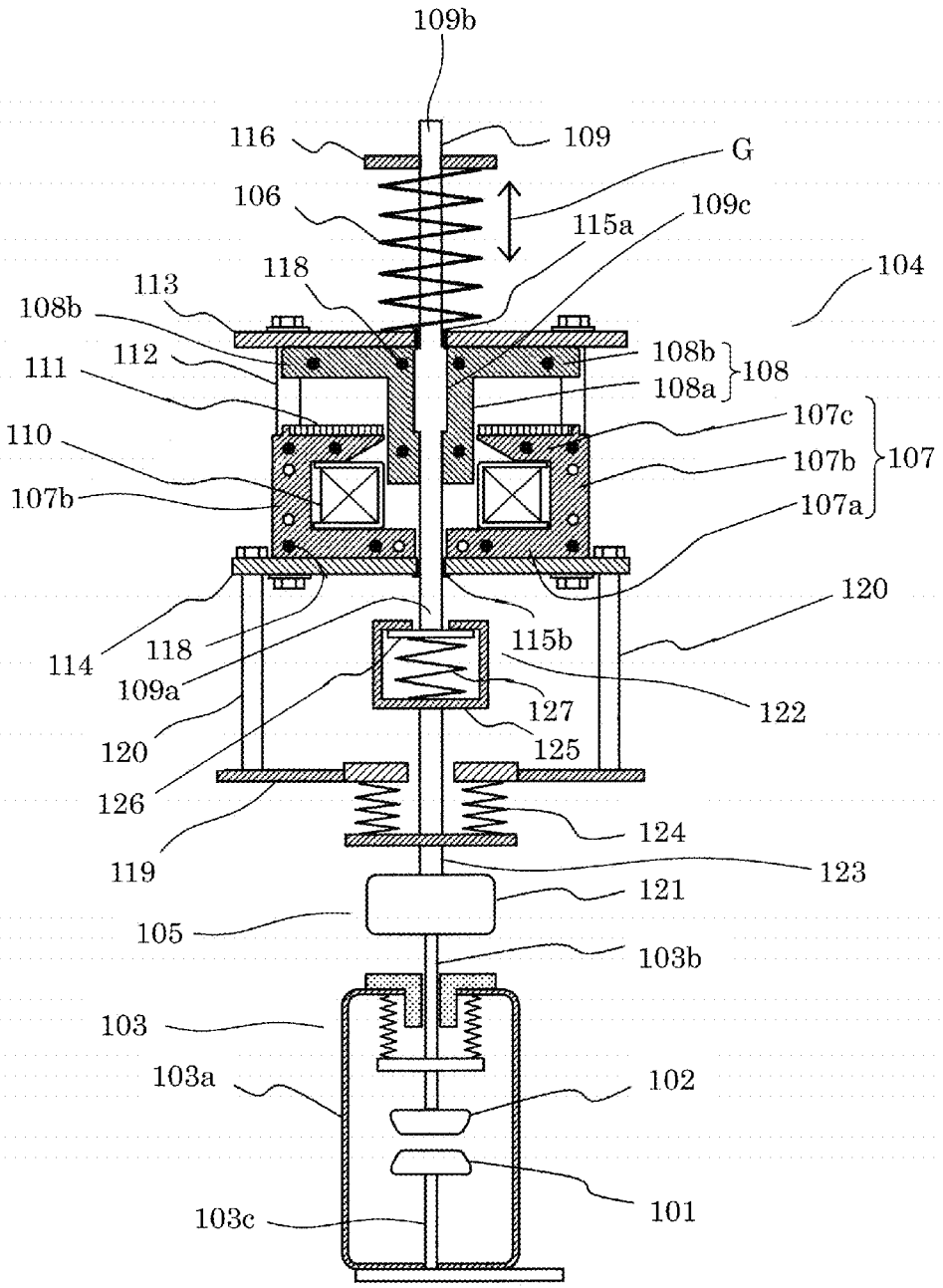
FIG. 6 is a sectional view showing an electromagnet device and a switch device using the electromagnet device, according to Embodiment 5 of the present invention.
Figure 7:
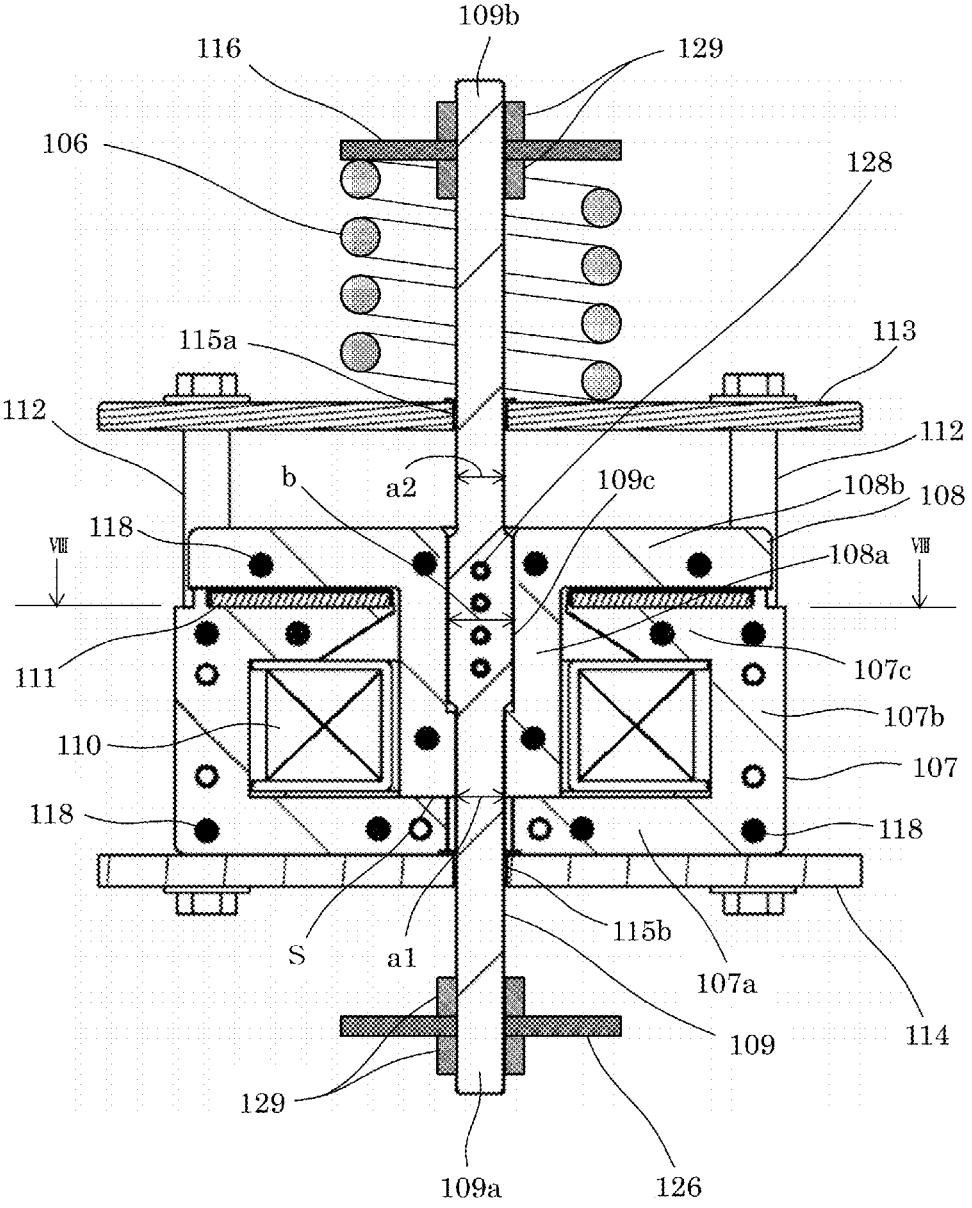
FIG. 7 is a sectional view showing an electromagnet device according to Embodiment 5 of the present invention.
Figure 8:
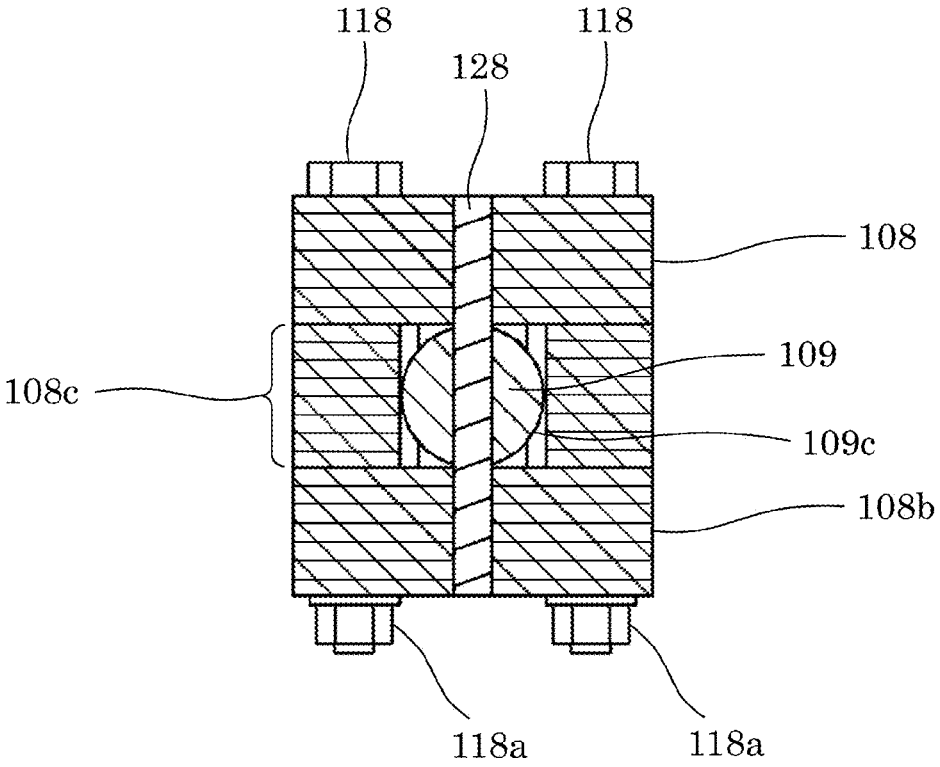
FIG. 8 is a sectional view taken along the line VIII-VIII of FIG. 7 showing the electromagnet device according to Embodiment 5 of the present invention.

Hereinafter, Embodiment 5 of the present invention will be described with reference to FIG. 6 to FIG. 8; and in each of the drawings, identical or equivalent members and portions will be described with the same reference numerals assigned thereto. FIG. 6 is a sectional view showing an electromagnet device and a switch device using the electromagnet device, according to Embodiment 5 of the present invention. FIG. 7 is a sectional view showing the electromagnet device according to Embodiment 5 of the present invention. FIG. 8 is a sectional view taken along the line VIII-VIII of FIG. 7 showing the electromagnet device according to Embodiment 5 of the present invention.

In these respective drawings, the switch device includes: a vacuum valve 103 serving as a switch device body having a fixed contact 101 and a movable contact 102; an electromagnet device 104 that displaces the movable contact 102 of the vacuum valve 103 in a direction connected to and separated from the fixed contact 101; a coupling device 105 that couples the vacuum valve 103 to the electromagnet device 104; and an open-contact spring 106 serving as a biasing body which biases the movable contact 102 in a direction to be separated from the fixed contact 101.

The vacuum valve 103 serving as the switch device body incorporates the fixed contact 101 and the movable contact 102 in an insulation container 103*a*; and one end of the movable electrode rod 103*b* fixed to the movable contact 102 is led out to the outside from the insulation container 103*a* and is coupled to the movable side of the electromagnet device 104 via the coupling device 105. This moves and displaces the movable contact 102 in the axial direction of the vacuum valve 103. The movable contact 102 is brought in contact with the fixed contact 101 to perform close-contact; and the movable contact 102 is separated from the fixed contact 101 to perform open-contact. The inside of the vacuum valve 103 is maintained in vacuum in order to improve arc extinguishing performance between the fixed contact 101 and the movable contact 102. Incidentally, a fixed electrode rod 103*c* is fixed to the fixed contact 101.

The electromagnet device 104 includes: a fixed core 107 configured by laminating a plurality of magnetic substance sheets; a movable core 108 which is configured by laminating a plurality of magnetic substance sheets and is arranged so as to move backward and forward in the fixed core 107; a driving shaft 109 which is provided by passing through a central portion of the movable core 108 and is fixed to the movable core 108; an electromagnetic coil 110 which is provided on the fixed core 107 and generates a magnetic field by energization; a permanent magnet 111 provided on the fixed core 107 side; braces 112 that fix the fixed core 107; and an open-contact side plate 113 and a close-contact side plate 114, which are arranged on both ends of the braces 112. The movable core 108 is capable of being displaced by being driven to the axial direction of the driving shaft 109 (hereinafter, merely referred to as the "axial direction") G with respect to the fixed core 107.

Further, bearings 115*a*, 115*b* of the driving shaft 109 are fixed to portions at which the driving shaft 109 passes through the open-contact side plate 113 and the close-contact side plate 114, respectively.

In addition, an open-contact spring receiver 116 is fixed to the other side 109*b* of the driving shaft 109 protruded to the outside from the open-contact side plate 113; and an open-contact spring 106 serving as a biasing body is inserted onto the driving shaft 109 between the open-contact side plate 113 and the open-contact spring receiver 116. The open-contact spring 106 is, for example, a compressed coil spring and generates elastic repulsive force in the axial direction G between the open-contact side plate 113 and the open-contact spring receiver 116.

Next, the configuration of the electromagnet device 104 will be further described in detail. The fixed core 107 and the movable core 108 are each configured by laminating the plurality of magnetic substance thin sheets. The shape of the fixed core 107 is such that the fixed core 107 has: a lateral core portion 107*a* extending in a direction perpendicular to the axial direction; a longitudinal core portion 107*b* extending in the axial direction from both end portions of the lateral core portion 107*a*; and a permanent magnet fixing portion 107*c* extending toward the axis line from the longitudinal core portion 107*b*. The longitudinal core portion 107*b* of the fixed core 107 is fastened and fixed to the braces 112 by being sandwiched by the braces 112 from both sides of the sheet surfaces of the longitudinal core portion 107*b*, that is, from both surfaces of the lamination direction.

On the other hand, the movable core 108 has: a major portion 108*a* arranged along the axial direction; and a pair of branch portions 108*b* which protrude from the sides of the major portion 108*a* in the opposite directions from each other toward directions perpendicular to the axial direction. The fixed core 107 and the movable core 108 are integrated by being fastened by a plurality of bolts 118 passing in the lamination direction and nuts (not shown in the drawing) screwed to the respective bolts 118. Then, the movable core 108 is capable of being displaced between a backward movement position at which the movable core 108 is separated from the fixed core 107 and comes in contact with the open-contact side plate 113 and a forward movement position at which the movable core 108 comes in contact with the fixed core 107.

Incidentally, a magnetic material with high permeability may be permissible as a material of the fixed core 107 and the movable core 108; and, for example, steel member, electromagnetic soft iron, silicon steel, ferrite, permalloy, and the like can be used.

Furthermore, a material with low permeability (low magnetic material), for example, stainless steel and the like can be used as a material of the driving shaft 109.

The permanent magnet 111 is arranged on the permanent magnet fixing portion 107*c* of the fixed core 107 in face-to-face relation to the surface of the close-contact side of the branch portion 108*b* of the movable core 108. Then, the permanent magnet 111 has an N-pole and an S-pole (a pair of magnetic poles); one magnetic pole is in face-to-face relation to the permanent magnet fixing portion 107*c* and the other magnetic pole is in face-to-face relation to the close-contact side of the branch portion 108*b* of the movable core 108. The permanent magnet 111 generates a holding magnetic flux that holds the movable core 108 at the forward movement position. Incidentally, the permanent magnet 111 may be fixed such that, for example, a mounting member formed by bending in a channel shape (not shown in the drawing) is placed from the upper side of the permanent magnet 111 and the mounting member is fastened by bolts in the lamination direction of the permanent magnet fixing portion 107*c*.

Furthermore, the electromagnetic coil 110 is arranged so as to pass between the major portion 108*a* of the movable core 108 and the longitudinal core portion 107*b* of the fixed core 107. In an example of this embodiment, the electromagnetic coil 110 surrounds the major portion 108*a* of the movable core 108 in a projection plane toward the axial direction. With this configuration, when the electromagnetic coil 110 is energized, the electromagnetic coil 110 generates a magnetic flux that passes through the fixed core 107 and the movable core 108. Furthermore, the direction of the magnetic flux generated by the electromagnetic coil 110 can be reversed by switching an energization direction to the electromagnetic coil 110.

Next, a coupling portion between the electromagnet device 104 and the vacuum valve 103 serving as the switch device body will be described. The electromagnet device 104 is supported to a plate-like supporting member 119 via mounting braces 120. Normally, the vacuum valve 103 is incorporated in a container (not shown in the drawing) sealed with insulating gas (for example, sulfur hexafluoride (SF6) gas, dry air, or the like) which is for securing dielectric strength voltage of a peripheral portion. Therefore, the above-mentioned supporting member 119 is, for example, a lid body of the container; the mounting braces 120 are arranged in a standing condition on the supporting member 119 made by the lid body; and the close-contact side plate 114 of the electromagnet device 104 is fixed to the mounting braces 120 by bolt fastening or the like. In this regard, however, the supporting member 119 is not limited to this; and, for example, a supporting plate of a switchboard may be permissible.

The coupling device 105 that couples the movable electrode rod 103*b* fixed to the movable contact 102 of the vacuum valve 103 to one side 109*a* of the driving shaft 109 of the electromagnet device 104 has: an insulation rod 121 coupled to the movable electrode rod 103*b*; a contact pressure device 122 interposed between the insulation rod 121 and one side 109*a* of the driving shaft 109; and a bellows 124 which is provided by connecting the coupling rod 123 portion and the supporting member 119 so that the coupling rod 123 portion is movable while maintaining hermetic seal with respect to the supporting member 119 serving as a part of the gas container in a portion in which the coupling rod 123 portion of the insulation rod 121 passes through the supporting member 119. Incidentally, there is also a case where the bellows 124 is not needed according to the configuration of the supporting member 119.

The contact pressure device 122 has: a spring frame 125 fixed to an end portion of the coupling rod 123 portion; a latch plate 126 which is fixed to one side 109*a* of the driving shaft 109 and is arranged in the spring frame 125; and a contact pressure spring 127 inserted in a compressed state between the spring frame 125 and the latch plate 126. The contact pressure spring 127 biases the driving shaft 109 in a direction to be separated from the insulation rod 121. The driving shaft 109 is capable of being displaced in the axial direction together with the latch plate 126; and its displacement is regulated by engagement of the latch plate 126 with the spring frame 125.

FIG. 6 shows that an axis line of the electromagnet device 104 and an axis line of the vacuum valve 103 are arranged in a straight line; however, a configuration may also be such that the directions of both axis lines are converted by interposing a lever or the like in the coupling device 105 portion.

Next, the operation of the switch device will be described. When the movable contact 102 is in an open-contact state being separated from the fixed contact 101, the movable core 108 is at the backward movement position by the biasing force of the open-contact spring 106. When energization is performed to the electromagnetic coil 110, the movable core 108 is suctioned to the fixed core 107 and is displaced from the backward movement position toward the forward movement position against a load of the open-contact spring 106. This moves the movable contact 102 toward the fixed contact 101.

After that, when the movable contact 102 comes in contact with the fixed contact 101, the movable contact 102 stops its movement. However, the movable core 108 is further displaced; and the major portion 108*a* comes in contact with the lateral core portion 107*a* of the fixed core 107 to reach the forward movement position. This shortens the contact pressure spring 127; and the movable contact 102 is pressed to the fixed contact 101 by a predetermined pressing force to complete close-contact operation.

When the movable core 108 reaches the forward movement position, the movable core 108 is sucked and held by the holding magnetic flux of the permanent magnet 111 to be held at the forward movement position.

In the case of releasing the forward movement position of the movable core 108 from being held, energization to the electromagnetic coil 110 is performed in a direction opposite to that during the close-contact operation. This lowers the suction force between the movable core 108 and the fixed core 107; and thus, the movable core 108 moves to the backward movement position by each load of the open-contact spring 106 and the contact pressure spring 127. In the early stages of the displacement, the movable contact 102 remains pressed to the fixed contact 101.

After that, when the displacement of the movable core 108 toward the backward movement position proceeds, the latch plate 126 is engaged with the spring frame 125. This displaces the movable contact 102 in a direction to be separated from the fixed contact 101. When the movable core 108 is further displaced and fixed by coming in contact with the open-contact side plate 113 to reach the backward movement position (the state of FIG. 6), open-contact operation is completed.

FIG. 7 shows a driving shaft portion of the electromagnet device in the switch device of Embodiment 5 of the present invention. The movable core 108 and the fixed core 107 are each configured by laminating the plurality of magnetic substance thin iron sheets. The driving shaft 109 passes through a central portion of the movable core 108 and is configured as one shaft body coupled to the movable core 108 by, for example, rod bodies 128 serving as coupling members at a connection portion 109*c* with the movable core 108. The shaft diameter of the connection portion 109*c* of the driving shaft 109 is configured as a shaft diameter that is different from the shaft diameter of other portion of the driving shaft 109. The driving shaft 109 is coupled to the movable core 108 by the rod bodies 128; and therefore, the connection portion 109*c* of the driving shaft 109 has a predetermined shaft diameter in order to improve strength.

On the other hand, a coupling portion of the open-contact spring receiver 116 of the open-contact spring 106 positioned at the other side 109*b* of the driving shaft 109 and a coupling portion of the latch plate 126 of the contact pressure device 122 have shaft diameters each having a predetermined strength necessary for a load generated at each coupling portion during operation of the switch device.

Therefore, the driving shaft 109 is different in each shaft diameter: a shaft diameter b of the connection portion 109*c* serving as the coupling portion by the rod body 128 with the movable core 108; a shaft diameter a2 of the other side 109*b* serving as the coupling portion on the open-contact spring receiver 116 side; and a shaft diameter a1 of one side 109*a* serving as the coupling portion with the latch plate 126. The shaft diameter a1 of one side 109*a* of the driving shaft 109 and the shaft diameter a2 of the other side 109*b* thereof are configured to be smaller than the shaft diameter b of the connection portion 109*c* of the driving shaft 109. More specifically, the shaft diameter a1 of one side 109*a* of the driving shaft 109 at the movable core 108 portion to be suctioned to the fixed core 107 is configured to be smaller than the shaft diameter b of the connection portion 109*c* of the driving shaft 109 coupled to the movable core 108 by the rod bodies 128. Incidentally, in FIG. 7, the open-contact spring receiver 116 and the latch plate 126 are fixed by being fastened from both sides by nuts 129 that are general fastening parts.

These nuts 129 are different in outer diameter according to the shaft diameter of the driving shaft 109. The nut 129 to be used for the shaft with a large shaft diameter is also large in dimension of the axial direction. The nut 129 to be used for the shaft with a small shaft diameter is also small in dimension of the axial direction. Thus, as compared to the case of one driving shaft 109 that keeps the shaft diameter of the connection portion 109*c* of the driving shaft 109 with the movable core 108, the nuts 129 of the coupling portions with the open-contact spring receiver 116 and the latch plate 26 can be reduced in size; and therefore, axial dimension can be shortened and the entire dimensions of the switch device can be reduced.

The electromagnet device of Embodiment 5 of the present invention can increase or decrease suction holding force generated by the electromagnet device in response to opening/closing operating force required for each rating in the switch device by an increase or decrease in the number of laminated sheets of the movable core and the fixed core. The shapes of the thin sheets constituting the respective cores can be the same; and therefore, the suction holding force can be easily adjusted.

FIG. 8 is a sectional view taken along the line VIII-VIII of FIG. 7 with regard to the movable core 108. In the driving shaft portion, the connection portion 109*c* of the driving shaft 109 with the movable core 108 is fixed by coupling with the rod bodies 128 serving as the coupling members; and therefore, as shown in FIG. 8, the driving shaft 109 can be fixed to the movable core 108 if the number of laminated sheets of a driving shaft pass-through portion 108*c* of the movable core 108 is adjusted according to the shaft diameter of the connection portion 109*c* of the driving shaft 109, the connection portion 109*c* being the coupling portion with the movable core 108.

Furthermore, the bearing 115*a* of the driving shaft 109 is fixed to a through hole of the open-contact side plate 113 and the bearing 115*b* of the driving shaft 109 is fixed to a through hole of the close-contact side plate 114, the open-contact side plate 113 and the close-contact side plate 114 being provided differently from the fixed core 107, thereby allowing to easily deal with a change in shaft diameter of the driving shaft 109 by only changing hole dimensions and thereby allowing to easily deal with a plurality of ratings.

Therefore, the shape of the thin sheets constituting the fixed core 107 and the movable core 108 can be constant regardless of the rating of the switch device by adopting the configuration of the present invention. Further, optimization of the dimensions of the switch device by virtue of optimizing each coupling portion of the driving shaft 109 by reducing the size of the nuts can be easily performed by only changing the dimensions of the bearing holes of the open-contact side plate 113 and the close-contact side plate 114 of the electromagnet device 104.

As described above, it can be easily dealt with each rating; and therefore, in manufacturing the electromagnet device 104, pressing metal dies of the fixed core 107 and the movable core 108 do not need to be prepared for each rating and can be standardized. The amount of initial investment of the pressing metal dies can be reduced and it further becomes possible to reduce costs by the effect of mass production.

In Embodiment 5 of the present invention, the suction holding force of the electromagnet device 104 is increased or reduced according to the area of a contact portion S between the movable core 108 and the fixed core 107, the suction holding force being for maintaining a close-contact state of the switch device with respect to the loads of the open-contact spring 106 and the contact pressure spring 127. In order to secure the area, if the movable core 108 becomes large and the weight of a movable portion is increased, a problem arises in that switching speed necessary for the function of the switch device cannot be satisfied. In Embodiment 5 of the present invention, the shaft diameter a1 of one side 109*a* of the driving shaft 109 at the contact portion S between the movable core 108 and the fixed core 107 is made smaller with respect to the shaft diameter b of the connection portion 109*c* of the driving shaft 109, the connection portion 109*c* being the coupling portion with the movable core 108; and thus, the area of the contact portion S between the movable core 108 and the fixed core 107 can be larger as compared to the case when the shaft diameter of the driving shaft 109 is set to be constant. More specifically, the movable core 108 can be reduced while securing the area of the contact portion S; and therefore, the electromagnet device 104 can reduce the movable core 108 which is for satisfying the suction holding force which is for maintaining the close-contact state of the switch device and the entire dimensions of the electromagnet device 104 can be reduced in size.

Furthermore, the amount of expensive permanent magnet 111 to be mounted in order to satisfy the suction holding force of the electromagnet device 104 can also be reduced; and therefore, the electromagnet device 104 can be reduced in cost.

Moreover, in the configuration of Embodiment 5 of the present invention, the driving shaft 109 is one shaft body. In the driving shaft 109 coupled to the movable core 108, the driving shaft 109 has highly accurate coaxiality as compared to the case where the driving shaft 109 is composed of a plurality of parts being coupled, the driving shaft 109 being supported by the bearing 115*a* portion of the open-contact side plate 113 and the bearing 115*b* portion of the close-contact side plate 114. Therefore, friction of the bearing 115*a*, 115*b* portions can be reduced, operational failure due to operational loss and shaft center deviation of the electromagnet device 104 can be reduced.

Embodiment 6

Embodiment 6 relates to an electromagnet device and a switch device using the electromagnet device, the electromagnet device having a structure in which a fixed core, a movable core, a driving shaft fixed by passing through the movable core, an electromagnetic coil that displaces the movable core to the fixed core along the driving shaft, an open-contact spring that displaces the movable core in a direction to be separated from the fixed core, and a cushioning device that reduces impacts during the completion of the displacement of the movable core are integrated with the driving shaft.

Hereinafter, the configuration and the operation of the electromagnet device and the switch device of Embodiment 6 of the present invention will be described with reference to FIG. 9 that is an entire configuration view, FIG. 10 and FIG. 11 that are configuration views of the electromagnet device, FIG. 12 that is a perspective view of the movable core of the electromagnet device, FIG. 13(*a*), 13(*b*), 13(*c*) that is a sectional view of a fixed core portion, and FIG. 14 and FIG. 15 that are other configuration views of the electromagnet device.

In the following description, first, the entire configuration of the electromagnet device and the switch device using the electromagnet device will be described. Next, the configuration and the operation of the electromagnet device will be described. Further, the configuration and the operation of the switch device will be described.

Incidentally, other embodiments of the present invention with regard to the electromagnet device of Embodiment 6 will be described by turns in Embodiment 7 to Embodiment 11.

First, a description will be made on the basic configuration of the electromagnet device and the entire configuration of the switch device using the electromagnet device with reference to FIG. 9.

Figure 9:
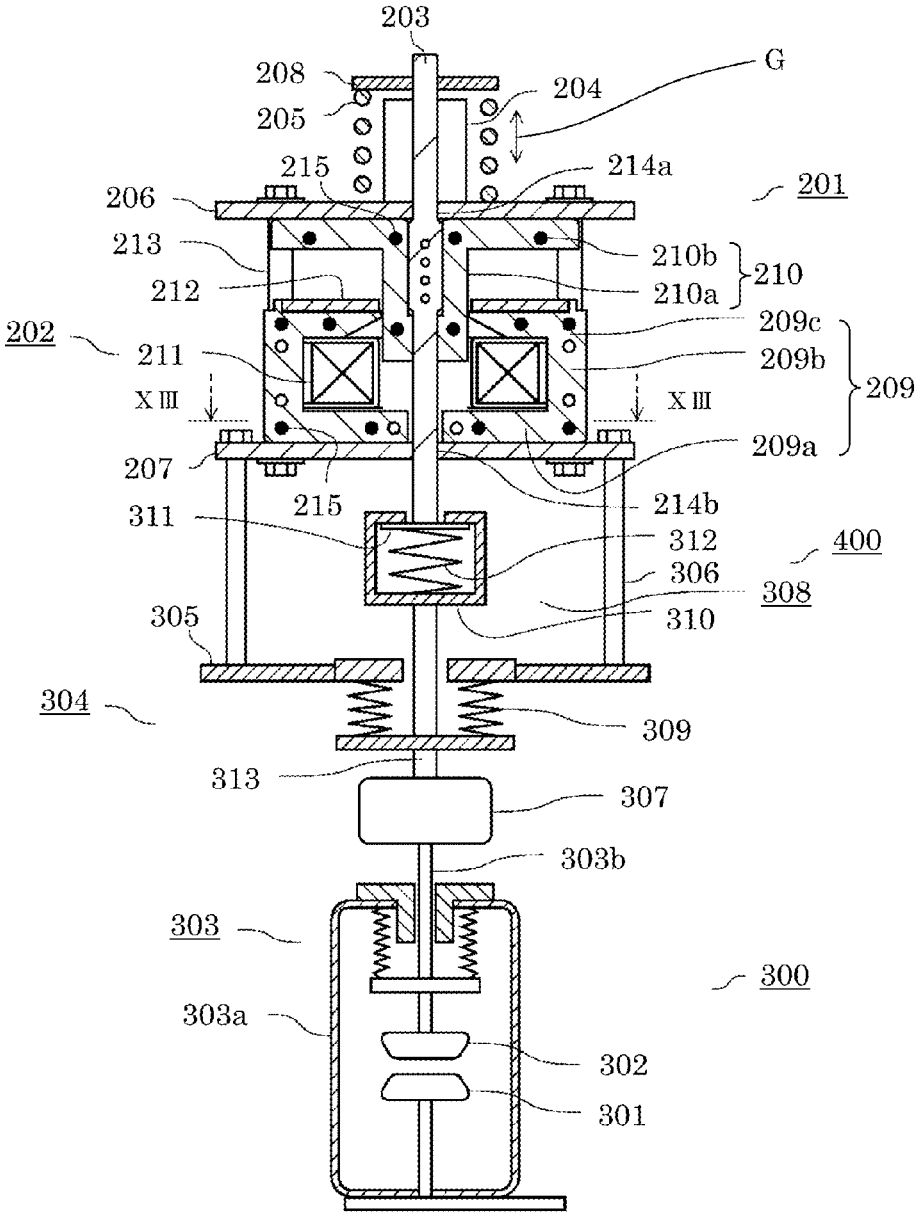
FIG. 9 is an entire configuration view of an electromagnet device and a switch device using the electromagnet device, according to Embodiment 6 of the present invention.

In FIG. 9, as a whole, a switch device 400 is composed of an electromagnet device 201 and an opening and closing operation portion 300.

The electromagnet device 201 has: an electromagnet portion 202; a driving shaft 203; a cushioning device 204; and an open-contact spring 205, as major constituent elements. The cushioning device 204 will be described later in a description of the electromagnet device 201 with reference to FIG. 10 and FIG. 11.

The electromagnet portion 202 has: a fixed core 209; a movable core 210; an electromagnetic coil 211; and a permanent magnet 212, as major constituent elements.

The opening and closing operation portion 300 includes a vacuum valve 303 and a coupling device 304.

First, the configuration and the operation of the electromagnet device 201 will be described with reference to FIG. 9 to FIG. 13. Incidentally, FIG. 10 and FIG. 11 are views each describing details of the cushioning device 204 of FIG. 9. FIG. 10 represents a state where the movable core 210, the driving shaft 203, and the vacuum valve 303 are in an open-contact side position. FIG. 11 represents a state where the movable core 210, the driving shaft 203, and the vacuum valve 303 are in a close-contact side position.

Incidentally, the open-contact side position and the close-contact side position will be described later. Furthermore, in FIG. 10 and FIG. 11, detailed reference numerals such as 209*a* to 209*c* of the electromagnet portion 202 are omitted.

The electromagnet portion 202 has: the fixed core 209, the movable core 210 arranged in face-to-face relation to the fixed core 209, and the driving shaft 203 which is provided by passing through a central portion of the movable core 210 and is fixed to the movable core 210. Furthermore, the electromagnet portion 202 has: the electromagnetic coil 211 which is provided on the fixed core 209 and generates a magnetic field by energization; and the permanent magnet 212 provided on the fixed core 209 side. Further, the electromagnet portion 202 has: braces 213 that fix the fixed core 209; and an upper plate 206 serving as an open-contact side plate and a lower plate 207 serving as a close-contact side plate, which are arranged on both ends of the braces 213.

Here, the movable core 210 is capable of being displaced by being driven to the axial direction of the driving shaft 203 (hereinafter, described as the "axial direction") with respect to the fixed core 209.

Further, a bearing 214*a* of the driving shaft 203 is fixed to a portion in which the driving shaft 203 passes through the upper plate 206; and a bearing 214*b* of the driving shaft 203 is fixed to a portion in which the driving shaft 203 passes through the lower plate 207.

Furthermore, a spring receiver 208 is fixed on the leading end side of the driving shaft 203 protruded to the outside from the upper plate 206. An open-contact spring 205 (biasing body) is inserted onto a shaft portion of the driving shaft 203 between the upper plate 206 and the spring receiver 208. The open-contact spring 205 is, for example, a compressed coil spring and generates elastic repulsive force in the axial direction between the upper plate 206 and the spring receiver 208. The biased open-contact spring displaces the movable core 210 in a direction to be separated from the fixed core 209 along the center axis of the driving shaft 203.

Incidentally, the open-contact spring 205 is an isolating spring of the present invention.

Next, details of the cushioning device 204 will be described with reference to FIG. 10.

The cushioning device 204 is arranged in the open-contact spring 205 and is fixed to the upper plate 206.

The cushioning device 204 is sealed with, for example, a liquid viscous body 204*c* in the inside thereof. The driving shaft 203 passing through the inside of the cushioning device 204 is provided with, for example, a disk-shaped cushioning body portion 204*b*. For example, a cylindrical upper cushioning chamber 204*d* and a cylindrical lower cushioning chamber 204*e* are provided on both end portions in the axial direction of the cushioning device 204. A structure is such that the upper and lower cushioning chambers 204*d*, 204*e* become small in inner diameter in the inside of the cushioning device 204; and the cushioning body portion 204*b* integrated with the driving shaft 203 is fitted thereinto.

When the cushioning body portion 204*b* is fitted (enters) into the upper cushioning chamber 204*d*, the viscous body 204*c* passes between the cushioning body portion 204*b* and the lower cushioning chamber 204*e*; and when the cushioning body portion 204*b* is fitted (enters) into the lower cushioning chamber 204*e*, the viscous body 204*c* passes between the cushioning body portion 204*b* and the upper cushioning chamber 204*d*. A movable portion is decelerated to reduce impacts by resistance of the viscous body 204*c* when the viscous body 204*c* passes between the cushioning body portion 204*b* and the upper cushioning chamber 204*d* and between the cushioning body portion 204*b* and the lower cushioning chamber 204*e*. The cushioning device 204 is sealed by connecting with an upper bellows 204*f* and a lower bellows 204*g* between the driving shaft 203 and a case of the cushioning device 204.

Incidentally, the upper cushioning chamber 204*d* and the lower cushioning chamber 204*e* are a cushioning chamber of the present invention.

Connection of the bellows is performed by a method such as welding or soldering. The upper bellows 204*f* and the lower bellows 204*g* are each provided with corrugations on a metal-made cylindrical one to have flexibility, airtightness, and spring property. In such a manner, the movable portion of the cushioning device 204 is sealed by the upper bellows 204*f* and the lower bellows 204*g*; and thus, the viscous body 204*c* is prevented from leaking to the outside of the cushioning device 204. A cushioning structure in the cushioning device 204 may be a general orifice structure.

Figure 10:
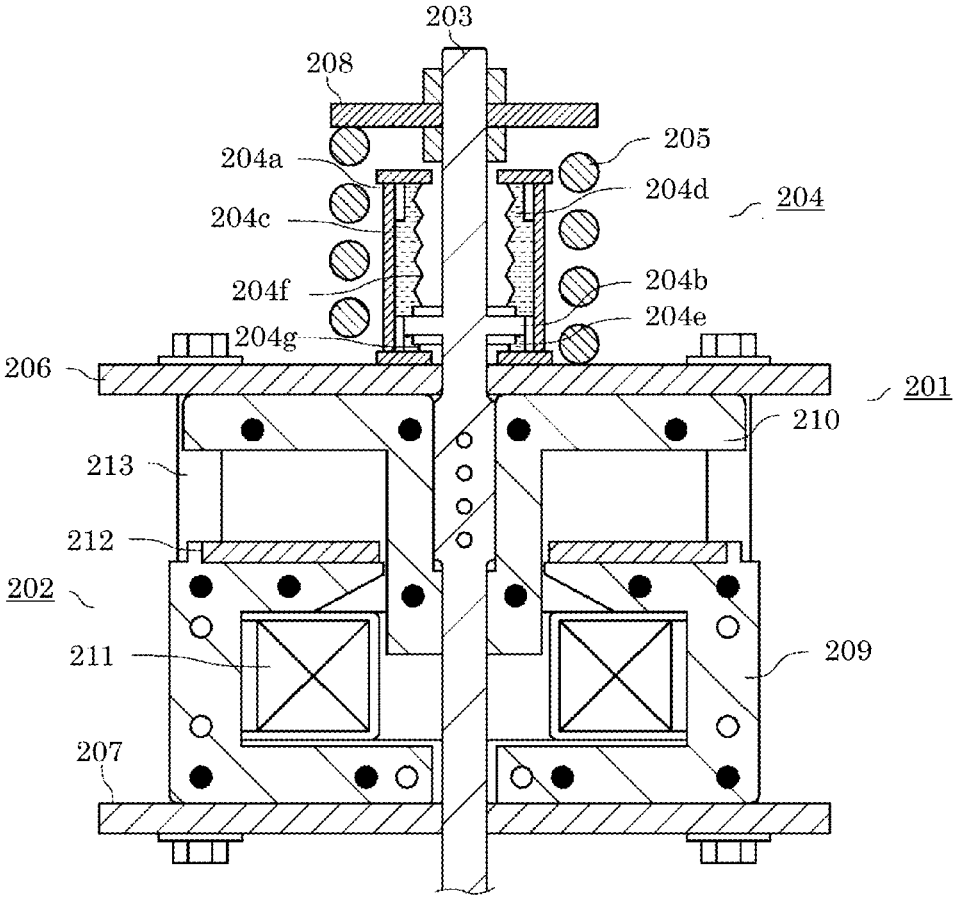
FIG. 10 is a configuration view according to the electromagnet device of Embodiment 6 of the present invention.
Figure 11:
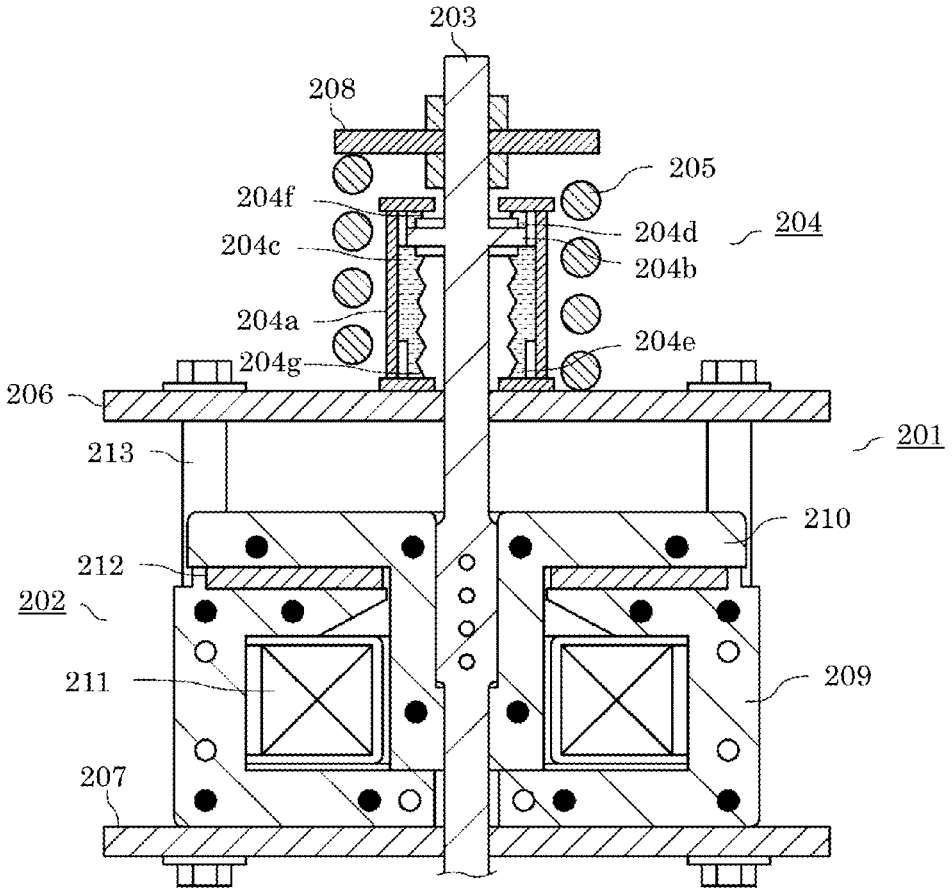
FIG. 11 is a configuration view according to the electromagnet device of Embodiment 6 of the present invention.
Figure 12:
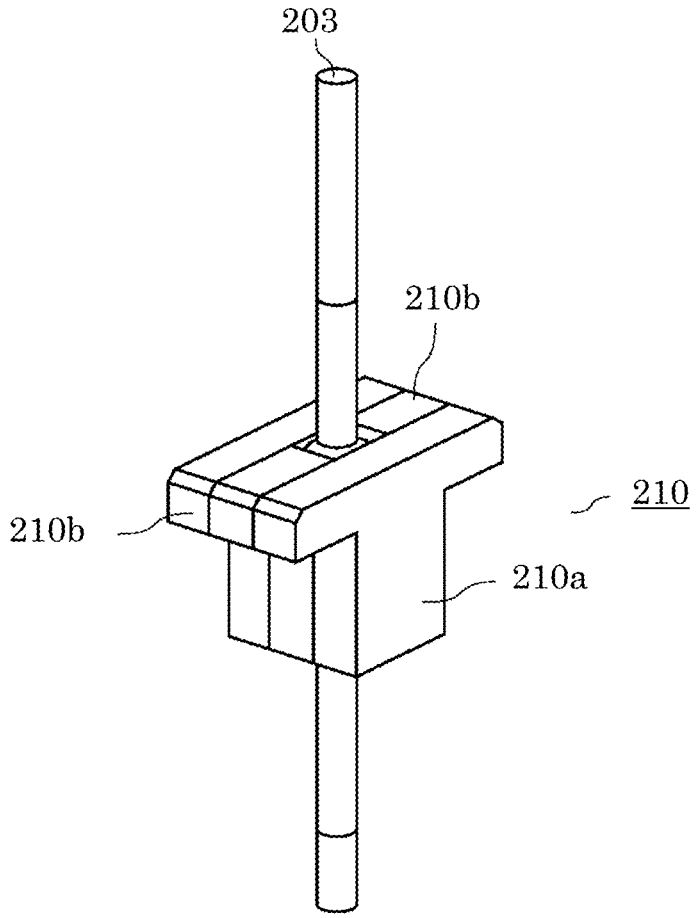
FIG. 12 is a perspective view of a movable core according to the electromagnet device of Embodiment 6 of the present invention.

FIG. 10 represents a state where the cushioning body portion 204*b* is fitted into the lower cushioning chamber 204*e*; whereas FIG. 11 represents a state where the cushioning body portion 204*b* is fitted into the upper cushioning chamber 204*d*.

The fixed core 209 and the movable core 210 of the electromagnet portion 202 will be further described in detail with reference to FIG. 9.

The fixed core 209 and the movable core 210 are each configured by laminating thin sheets. The fixed core 209 has: a lateral core portion 209*a* that extends in a direction perpendicular to the axial direction; a longitudinal core portion 209*b* that extends in the axial direction from both end portions of the lateral core portion 209*a*; and a permanent magnet fixing portion 209*c* that extends from the longitudinal core portion 209*b* toward the axis line.

The longitudinal core portion 209*b* of the fixed core 209 is fastened and fixed to the braces 213 by being sandwiched by the braces 213 from both sides of the sheet surfaces, that is, from both surfaces of the lamination direction.

Next, the movable core 210 will be described. FIG. 12 shows a perspective view of the movable core 210 having a T-shape.

The movable core 210 has: a major portion 210*a* arranged along the axial direction; and a pair of branch portions 210*b* which protrude from the sides of the major portion 210*a* in the opposite directions from each other toward directions perpendicular to the axial direction. The fixed core 209 and the movable core 210 are integrated by being fastened by a plurality of bolts 215 passing in the lamination direction and nuts (not shown in the drawing) screwed to the respective bolts 215. Then, the movable core 210 is capable of being displaced between a backward movement position at which the movable core 210 is separated from the fixed core 209 and comes in contact with the upper plate 206 and a forward movement position at which the movable core 210 comes in contact with the fixed core 209.

Figure 13:
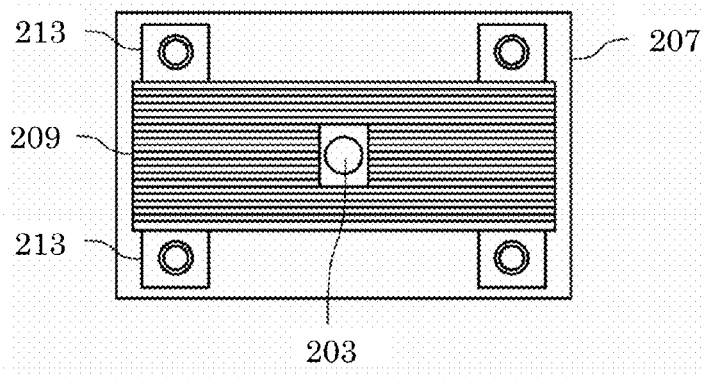
FIGS. 13(*a*), 13(*b*), 13(*c*) are sectional views and a related part view of a fixed core portion according to the electromagnet device of Embodiment 6 of the present invention.
Figure 13:
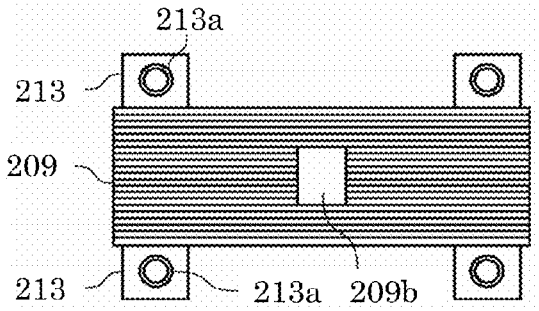
Figure 13:
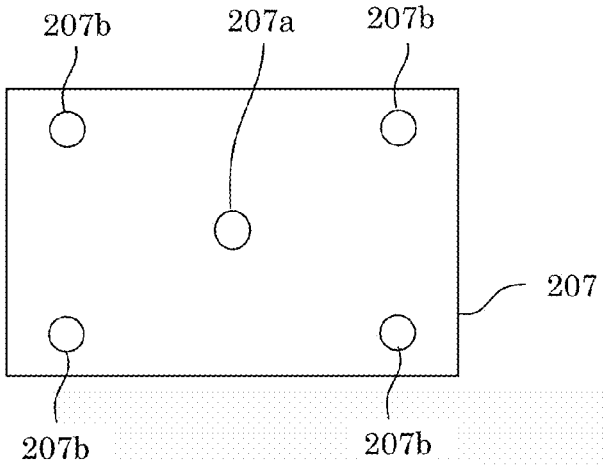
Figure 14:
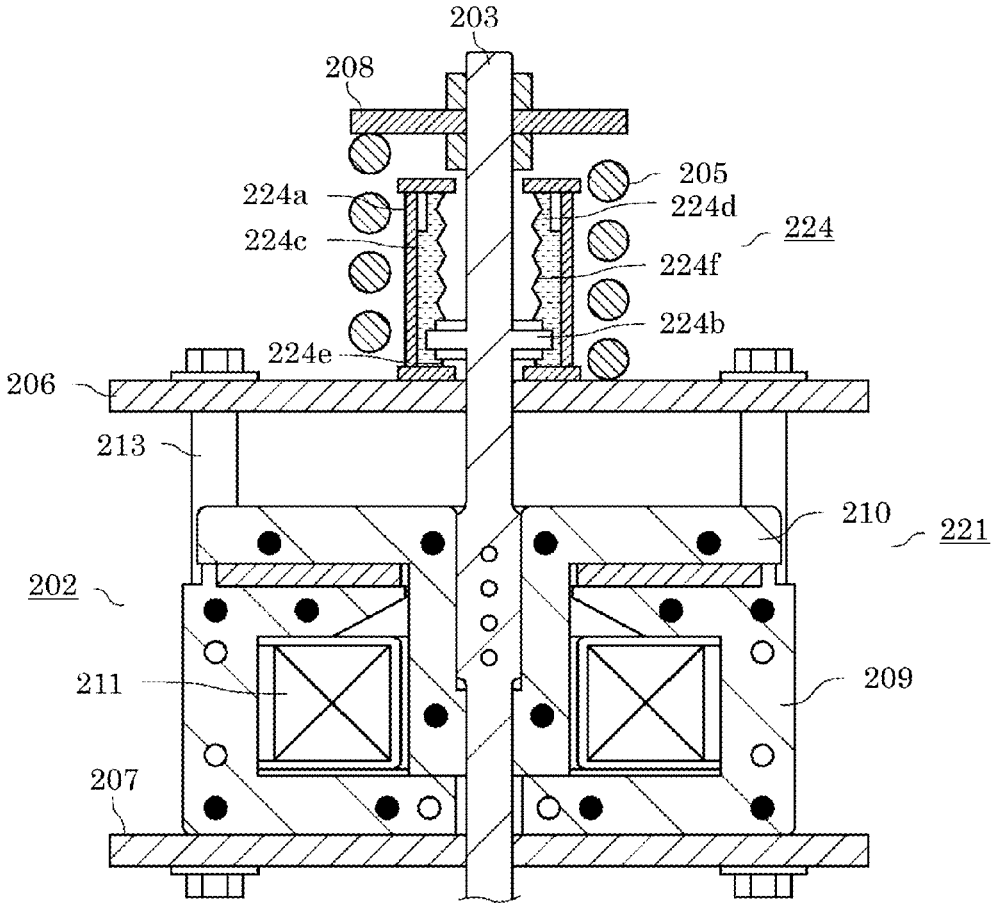
FIG. 14 is other configuration view according to an electromagnet device of Embodiment 6 of the present invention.

FIGS. 13(*a*), 13(*b*), 13(*c*) show sectional views and a related component view of the fixed core 209 portion seen from the line XIII-XIII of FIG. 9.

FIG. 13(*a*) is a sectional plan view in which a state where the fixed core 209, the braces 213, and the lower plate 207 are combined is seen from the line XIII-XIII of FIG. 9.

FIG. 13(*b*) is a plan view in which the fixed core 209 and the braces 213 are seen from the line XIII-XIII of FIG. 9. In FIG. 13(*b*), screw holes 213*a* for mounting the upper plate 206 and the lower plate 207 are processed on both end portions in the longitudinal direction of the braces 213. Furthermore, an opening hole 209*d* in which the driving shaft 203 movably passes is formed in the fixed core 209.

FIG. 13(*c*) is a plan view of the lower plate 207. In FIG. 13(*c*), the lower plate 207 is formed with a bearing mounting hole 207*a* in which the bearing 214*b* of the driving shaft 203 is mounted at a central portion and a plurality of brace mounting holes 207*b* which are for mounting the braces 213 at peripheral portions.

Incidentally, none of FIG. 13(*a*) to FIG. 13(*c*) show bolts.

Materials of the fixed core 209, the movable core 210, and the driving shaft 203 will be described.

A magnetic material with high permeability may be permissible as the material of the fixed core 209 and the movable core 210; and, for example, steel member, electromagnetic soft iron, silicon steel, ferrite, permalloy, and the like can be used.

Furthermore, a material with low permeability (low magnetic material), for example, stainless steel and the like can be used as the material of the driving shaft 203.

Next, the permanent magnet 212 will be described.

The permanent magnet 212 is arranged on the permanent magnet fixing portion 209*c* of the fixed core 209 in face-to-face relation to the surface of the lower side of the branch portion 210*b* of the movable core 210. Then, the permanent magnet 212 has an N-pole and an S-pole (a pair of magnetic poles). One magnetic pole of the permanent magnet 212 is in face-to-face relation to the permanent magnet fixing portion 209*c* and the other magnetic pole is in face-to-face relation to the lower side of the branch portion 210*b* of the movable core 210. The permanent magnet 212 generates a holding magnetic flux that holds the movable core 210 at the close-contact side position (forward movement position).

Incidentally, the permanent magnet 212 is fixed such that, for example, a mounting member formed by bending in a channel shape (not shown in the drawing) is placed from the upper side of the permanent magnet 212 and the mounting member is fastened by bolts in the lamination direction of the permanent magnet fixing portion 209*c*.

Next, the electromagnetic coil 211 will be described with reference to FIG. 9.

The electromagnetic coil 211 is arranged so as to pass between a major portion 210*a* of the movable core 210 and the longitudinal core portion 209*b* of the fixed core 209. In an example of this Embodiment 6, the electromagnetic coil 211 surrounds the major portion 210*a* of the movable core 210 in a projection plane toward the axial direction. When the electromagnetic coil 211 is energized, the electromagnetic coil 211 generates a magnetic flux that passes through the fixed core 209 and the movable core 210. Furthermore, the direction of the magnetic flux generated by the electromagnetic coil 211 can be reversed by switching an energization direction to the electromagnetic coil 211. The switching of the energization direction is performed by a control board (not shown in the drawing) connected to a capacitor.

Next, the vacuum valve 303 and the coupling device 304 will be described with reference to FIG. 9.

The vacuum valve 303 incorporates a fixed contact 301 and a movable contact 302 in an insulation container 303*a*. One end of a movable electrode rod 303*b* fixed to the movable contact 302 is led out to the outside from the insulation container 303*a* and is coupled to the driving shaft 203 of the electromagnet device 201 via the coupling device 304. This moves and displaces the movable contact 302 in the axial direction of the vacuum valve 303. The movable contact 302 is brought in contact with the fixed contact 301 to perform close-contact and is separated from the fixed contact 301 to perform open-contact. The inside of the vacuum valve 303 is maintained in vacuum in order to improve arc extinguishing performance between the fixed contact 301 and the movable contact 302.

The coupling device 304 includes: as major constituent elements; an insulation rod 307; a contact pressure device 308; a coupling bellows 309; and a coupling rod 313. The coupling device 304 includes a plate-like supporting member 305 and supporting braces 306, which are for coupling to the electromagnet portion 202 of the electromagnet device 201.

The contact pressure device 308 has: a spring frame 310 fixed to an end portion of the coupling rod 313; a latch plate 311 which is fixed to a tip end portion of the driving shaft 203 and is arranged in the spring frame 310; and a contact pressure spring 312 inserted in a compressed state between the spring frame 310 and the latch plate 311. The contact pressure spring 312 biases the driving shaft 203 in a direction to be separated from the insulation rod 307. The driving shaft 203 is capable of being displaced in the axial direction together with the latch plate 311; and its displacement is regulated by engagement with respect to the spring frame 310 of the latch plate 311.

The bellows 309 is provided to connect the coupling rod 313 portion and the supporting member 305 so that the coupling rod 313 portion is movable while maintaining hermetic seal with respect to the supporting member 305 serving as a part of the gas container in a portion in which the coupling rod 313 portion of the insulation rod 307 passes through the supporting member 305. Incidentally, there is also a case where the bellows 309 is not needed according to the configuration of the supporting member 305.

The electromagnet portion 202 is supported to the plate-like supporting member 305 via the supporting braces 306. Normally, the vacuum valve 303 is incorporated in a container (not shown in the drawing) sealed with insulating gas (for example, SF6 gas, dry air, or the like) which is for securing dielectric strength voltage of a peripheral portion. Therefore, the supporting member 305 is, for example, a lid body of the container; the supporting braces 306 are arranged in a standing condition on the supporting member 305 made by the lid body; and the lower plate 207 of the electromagnet portion 202 is fixed to the supporting braces 306 by bolt fastening or the like. In this regard, however, the supporting member 305 is not limited to this; and, for example, a supporting plate of a switchboard may be permissible.

Next, the open-contact and close-contact operation of the vacuum valve 303 of the switch device 400 will be described.

When the movable contact 302 is in an open-contact state being separated from the fixed contact 301, the movable core 210 is at the open-contact side position (backward movement position) by the biasing force of the open-contact spring 205. When energization is performed from the control board to the electromagnetic coil 211, the movable core 210 is suctioned to the fixed core 209 and is displaced from the open-contact side position (backward movement position) toward the close-contact side position (forward movement position) against a load of the open-contact spring 205. This moves the movable contact 302 toward the fixed contact 301.

After that, when the movable contact 302 comes in contact with the fixed contact 301, the movable contact 302 stops its movement. However, the movable core 210 is further displaced; and the major portion 210*a* comes in contact with the lateral core portion 209*a* of the fixed core 209 to reach the close-contact side position (forward movement position). This shortens the contact pressure spring 312; and the movable contact 302 is pressed to the fixed contact 301 by a predetermined pressing force to complete the close-contact operation.

When the close-contact operation is completed, the cushioning body portion 204*b* in the cushioning device 204 is fitted into the lower cushioning chamber 204*e* on the lower side (the close-contact side); and thus, speed is reduced by resistance of the viscous body 204*c* and impacts during the completion of the close-contact operation can be reduced.

When the movable core 210 reaches the close-contact side position (forward movement position), the movable core 210 is sucked and held by the holding magnetic flux of the permanent magnet 212 to be held at the close-contact side position (forward movement position).

In the case of releasing the close-contact side position (forward movement position) of the movable core 210 from being held, energization from the control board to the electromagnetic coil 211 is performed in a direction opposite to that during the close-contact operation. This lowers the suction force between the movable core 210 and the fixed core 209; and the movable core 210 moves to the open-contact side position (backward movement position) by each load of the open-contact spring 205 and the contact pressure spring 312. In the early stages of the displacement, the movable contact 302 remains pressed to the fixed contact 301.

After that, when the displacement of the movable core 210 toward the open-contact side position (backward movement position) proceeds, the latch plate 311 is engaged with the spring frame 310. This displaces the movable core 302 in a direction to be separated from the fixed contact 301. When the movable core 210 is further displaced and fixed by coming in contact with the upper plate 206 to reach the open-contact side position (backward movement position) (the state of FIG. 9), open-contact operation is completed.

When the open-contact operation is completed, the cushioning body portion 204*b* in the cushioning device 204 is fitted into the upper cushioning chamber 204*d* on the upper side (the open-contact side); and thus, speed is reduced by resistance of the viscous body 204*c* and impacts during the completion of the open-contact operation can be reduced.

In the electromagnet device 201 of Embodiment 6, the cushioning device 204 that reduces impacts during the completion of the close-contact operation and the open-contact operation is arranged in the open-contact spring 205; and therefore, there can be shortened the entire length of the electromagnet device 201 in which the cushioning device 204 and the electromagnet portion 202 are combined.

As shown in FIG. 9, in the switch device 400, the driving shaft 203 of the electromagnet device 201 is coupled to the movable electrode rod 303*b* fixed to the movable contact 302 of the vacuum valve 303. More specifically, in the switch device 400, an axis line of the electromagnet device 201 and an axis line of the vacuum valve 303 are arranged in a straight line; and therefore, the entire length of the device can be shortened.

For example, in an electromagnetic operation type vacuum circuit breaker disclosed in JP-A-2012-238505 (Patent Document 4), a damper (corresponding to the cushioning device 204 of this Embodiment 6) is arranged; and accordingly, the entire length is elongated. In the electromagnet device 201 of Embodiment 6 of the present invention, the driving shaft 203 and the cushioning device 204 are integrated; and thus, a space for only the cushioning device 204 can be reduced and the switch device 400 can be reduced in size.

When the switch device 400 is installed in an outdoor location, the switch device 400 is influenced by a fluctuation of an external temperature. In the cushioning device 204, when a rubber gasket is used as a material which is for sealing the viscous body 204*c* between the driving shaft 203 and the case of the cushioning device 204, the cushioning device 204 is influenced by the external temperature of installation environment. More particularly, in the case of a low temperature, there are cases where a standard rubber gasket hardens, sealing property deteriorates, and oil leakage occurs. There are cases where a rubber gasket made of a special material, which takes into consideration the affinity with the viscous body 204*c*; and accordingly, a problem exists in that standardization cannot be achieved.

In the electromagnet device 201 of Embodiment 6, the upper bellows 204*f* and the lower bellows 204*g* are connected to seal between the driving shaft 203 and the case of the cushioning device 204; and therefore, the viscous body 204*c* is not influenced by ambient temperature. Therefore, standardization can be achieved in a unified manner at all environmental temperatures of the cushioning device 204.

In FIG. 10 and FIG. 11, both of the upper cushioning chamber 204*d* and the lower cushioning chamber 204*e* are provided in the cushioning device 204; however, the cushioning chamber can be provided only on one side. FIG. 14 shows an electromagnet device 221 having a configuration in which only an upper cushioning chamber 224*d* is provided in a cushioning device 224. The electromagnet device 221 can reduce impacts during open-contact.

Figure 15:
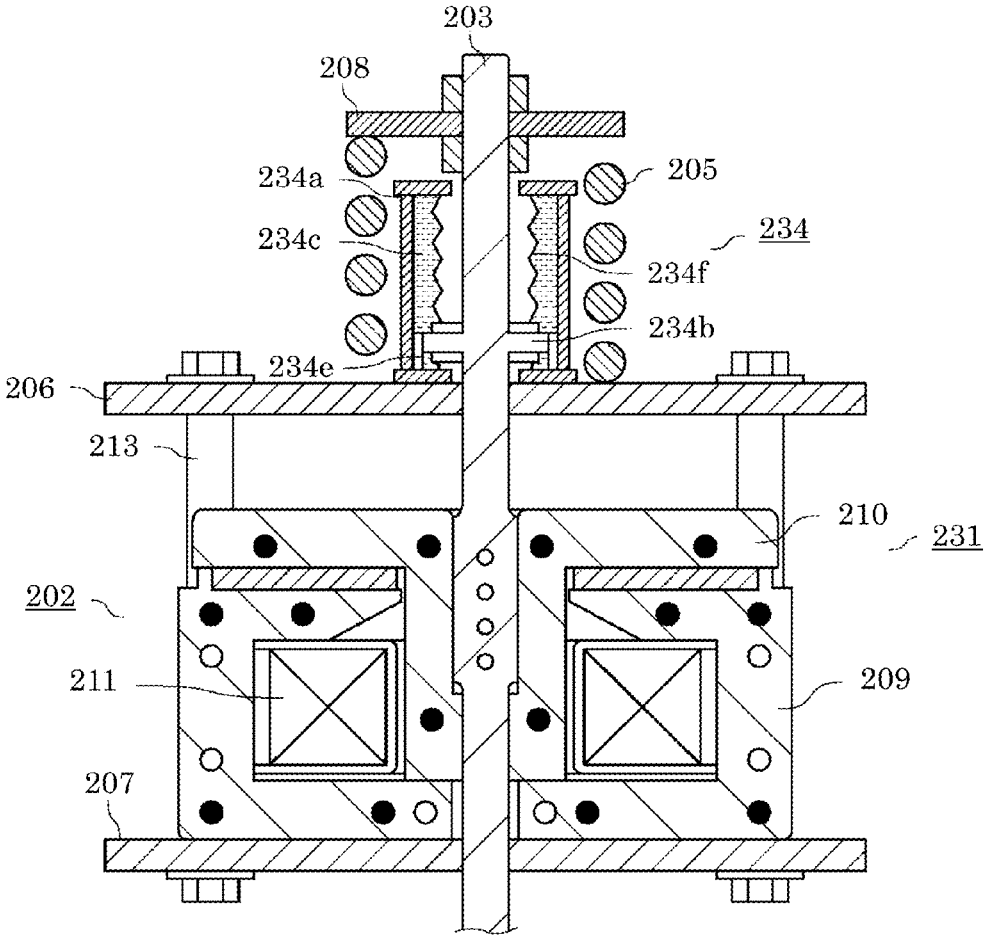
FIG. 15 is other configuration view according to an electromagnet device of Embodiment 6 of the present invention.

FIG. 15 shows an electromagnet device 231 having a configuration in which only a lower cushioning chamber 234*e* is provided in a cushioning device 234. The electromagnet device 231 can reduce impacts during close-contact.

FIG. 9 shows that the axis line of the driving shaft 203 of the electromagnet device 201 and the axis line of the vacuum valve 303 are arranged in a straight line. However, a configuration can also be such that the directions of both axis lines are converted by interposing a lever or the like in the coupling device 304 portion.

As described above, in the electromagnet device according to Embodiment 6, the fixed core, the movable core, the driving shaft fixed by passing through the movable core, the electromagnetic coil that displaces the movable core to the fixed core along the driving shaft, the open-contact spring that displaces the movable core in the direction to be separated from the fixed core, and the cushioning device that reduces impacts during the completion of the displacement of the movable core are integrated with the driving shaft. Therefore, the electromagnet device can be provided with the cushioning device which reduces impacts during the completion of the close-contact and the open-contact operation and there has an effect that the entire device can be reduced in size.

Furthermore, the switch device using the electromagnet device according to Embodiment 6 is configured such that the driving shaft of the electromagnet device is coupled to the movable electrode rod fixed to the movable contact of the vacuum valve and the axis line of the electromagnet device and the axis line of the vacuum valve arranged in a straight line. Therefore, the switch device has a function which reduces impacts during the completion of the close-contact and open-contact operation and has an effect that the entire switch device can be reduced in size.

Embodiment 7

In Embodiment 6, the cushioning device is placed on the upper plate of the electromagnet portion in the electromagnet device. However, in this Embodiment 7, a configuration is made such that a connection portion is provided between a cushioning device and an electromagnet portion.

Hereinafter, with regard to the configuration and the operation of Embodiment 7 of the present invention, a description will be made centering on differences from Embodiment 6 with reference to FIG. 16 serving as a configuration view of an electromagnet device 241.

Figure 16:
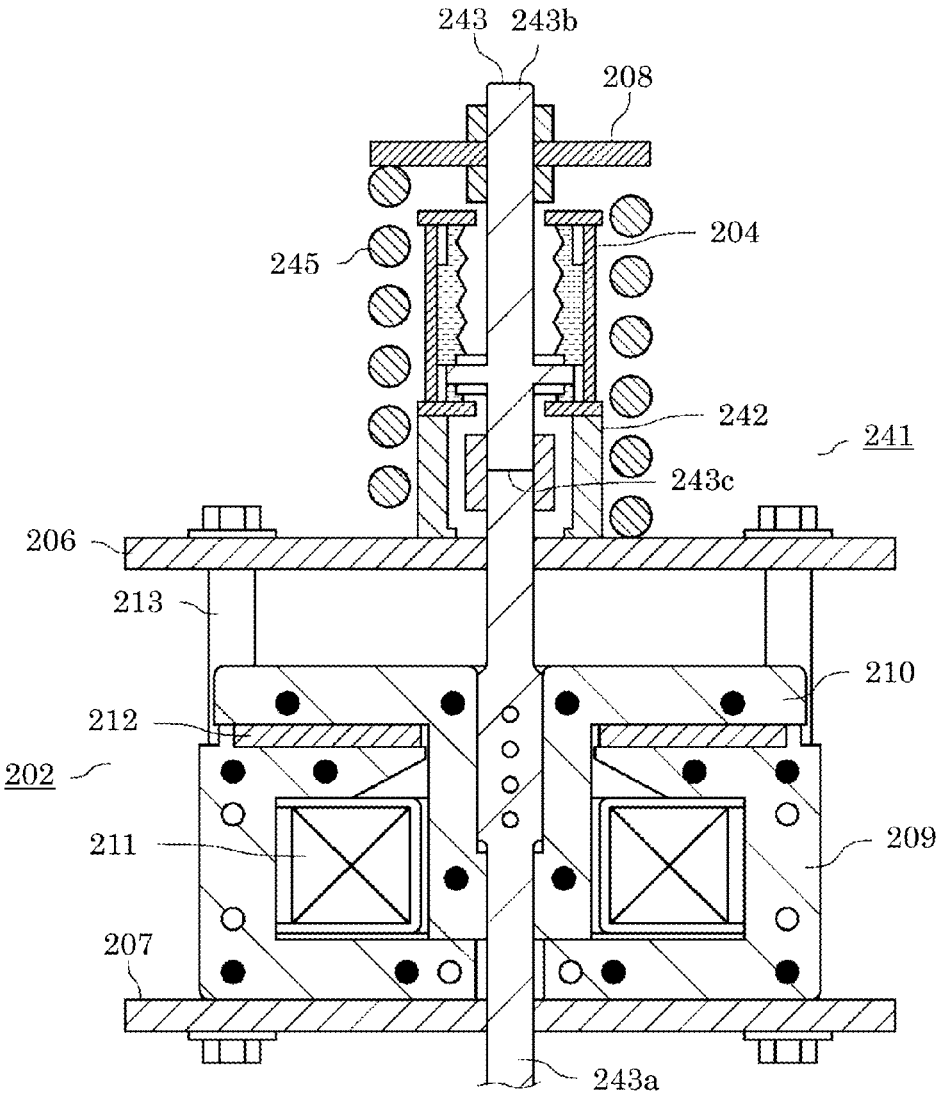
FIG. 16 is a configuration view according to an electromagnet device of Embodiment 7 of the present invention.

In FIG. 16, the same reference numerals are given to those identical or equivalent to portions in FIG. 10 and FIG. 11, each serving as the configuration view of the electromagnet device 201 of Embodiment 6.

An electromagnet portion 202 has: a fixed core 209, a movable core 210 arranged in face-to-face relation to the fixed core 209, and a driving shaft 243 which is provided by passing through a central portion of the movable core 210 and is fixed to the movable core 210. Furthermore, the electromagnet portion 202 has: an electromagnetic coil 211 which is provided on the fixed core 209 and generates a magnetic field by energization; and a permanent magnet 212 provided on the fixed core 209 side. Further, the electromagnet portion 202 has: braces 213 that fix the fixed core 209; and an upper plate 206 serving as an open-contact side plate and a lower plate 207 serving as a close-contact side plate, which are arranged on both ends of the braces 213.

A spring receiver 208 is fixed on the leading end side of the driving shaft 243 protruded to the outside from the upper plate 206. An open-contact spring 245 (biasing body) is inserted onto a shaft portion of the driving shaft 243 between the upper plate 206 and the spring receiver 208. The open-contact spring 245 is a compressed coil spring and generates elastic repulsive force in the axial direction between the upper plate 206 and the spring receiver 208.

A cushioning device 204 is fixed to the upper plate 206 via a connection portion 242. The cushioning device 204 and the connection portion 242 are arranged in the open-contact spring 245. In the driving shaft 243 of the electromagnet device 241, a driving shaft 243*a* of the electromagnet portion 202 and a driving shaft 243*b* of a cushioning device 204 portion are coupled at a coupling portion 243*c*.

The connection portion 242 is provided between the cushioning device 204 and the electromagnet portion 202; and thus, even when breakage of the cushioning device 204 occurs by any chance, replacement can be made by removing only the cushioning device 204 portion at the coupling portion 243*c*. Therefore, during the breakage of the cushioning device 204, it can be dealt with by the replacement of only the cushioning device 204 portion, the replacement of the electromagnet portion 202 is not needed and maintainability can be improved.

As described above, the electromagnet device according to Embodiment 7 is configured such that the connection portion is placed between the cushioning device and the electromagnet portion. Therefore, effects are exhibited as in the electromagnet device of Embodiment 6 and there has an effect that it can be dealt with by only the replacement of the cushioning device portion during the breakage of the cushioning device.

Embodiment 8

Embodiment 8 relates to an electromagnet device which is structured such that a cushioning device is placed on the lower surface of an upper plate and is incorporated in a concave portion provided on a movable core.

Hereinafter, the configuration and the operation of Embodiment 8 of the present invention will be described centering on differences from Embodiment 6 with reference to FIG. 17 serving as a configuration view of an electromagnet device 251.

An electromagnet portion 252 has: a fixed core 259; a movable core 260 arranged in face-to-face relation to the fixed core 259; and a driving shaft 253 which is provided by passing through a central portion of the movable core 260 and is fixed to the movable core 260. Furthermore, the electromagnet portion 252 has: an electromagnetic coil 261 which is provided on the fixed core 259 and generates a magnetic field by energization; and a permanent magnet 262 provided on the fixed core 259 side. Further, the electromagnet portion 252 has: braces 263 that fix the fixed core 259; and an upper plate 256 serving as an open-contact side plate and a lower plate 257 serving as a close-contact side plate, which are arranged on both ends of the braces 263.

A spring receiver 258 is fixed on the leading end side of the driving shaft 253 protruded to the outside from the upper plate 256. An open-contact spring 255 (biasing body) is inserted onto a shaft portion of the driving shaft 253 between the upper plate 256 and the spring receiver 258. The open-contact spring 255 is a compressed coil spring and generates elastic repulsive force in the axial direction between the upper plate 256 and the spring receiver 258.

Next, the placing position of a cushioning device 254 will be described.

A concave portion 266 surrounding the driving shaft 253 is provided on an upper portion of the movable core 260. The cushioning device 254 is fixed to the lower surface of the upper plate 256 serving as the open-contact side plate. When the movable core 260 is displaced from an open-contact side position (backward movement position) to a close-contact side position (forward movement position) or is displaced from the close-contact side position (forward movement position) to the open-contact side position (backward movement position), the cushioning device 254 is displaced inside the concave portion 266 of the movable core 260.

As described above, the electromagnet device according to Embodiment 8 is structured such that the cushioning device is fixed to the lower surface of the upper plate and is incorporated in the concave portion provided on the movable core. Therefore, the electromagnet device can be provided with the cushioning device which reduces impacts during the completion of the close-contact and the open-contact operation and there has an effect that the entire device can be reduced in size.

Embodiment 9

The open-contact spring is provided on the upper portion of the upper plate in Embodiment 8; whereas, Embodiment 9 relates to an electromagnet device which is structured such that an open-contact spring is provided between a branch portion of a movable core and a lower plate.

Hereinafter, the configuration and the operation of Embodiment 9 of the present invention will be described centering on differences from Embodiment 6 with reference to FIG. 18 serving as a configuration view of an electromagnet device 271.

Figure 17:
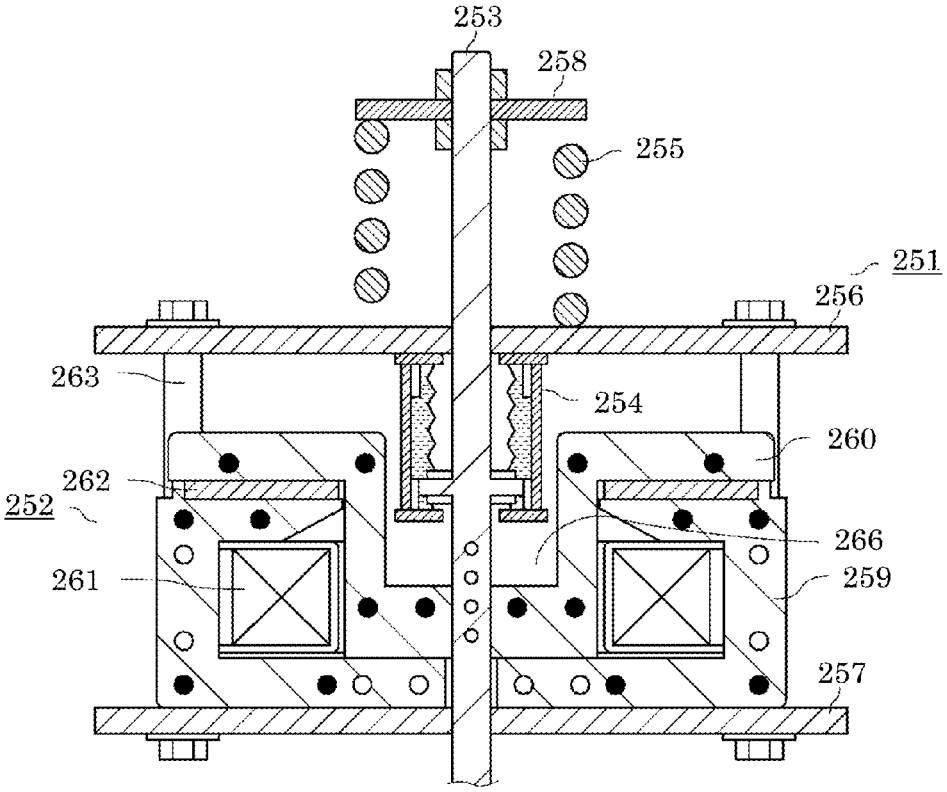
FIG. 17 is a configuration view according to an electromagnet device of Embodiment 8 of the present invention.
Figure 18:
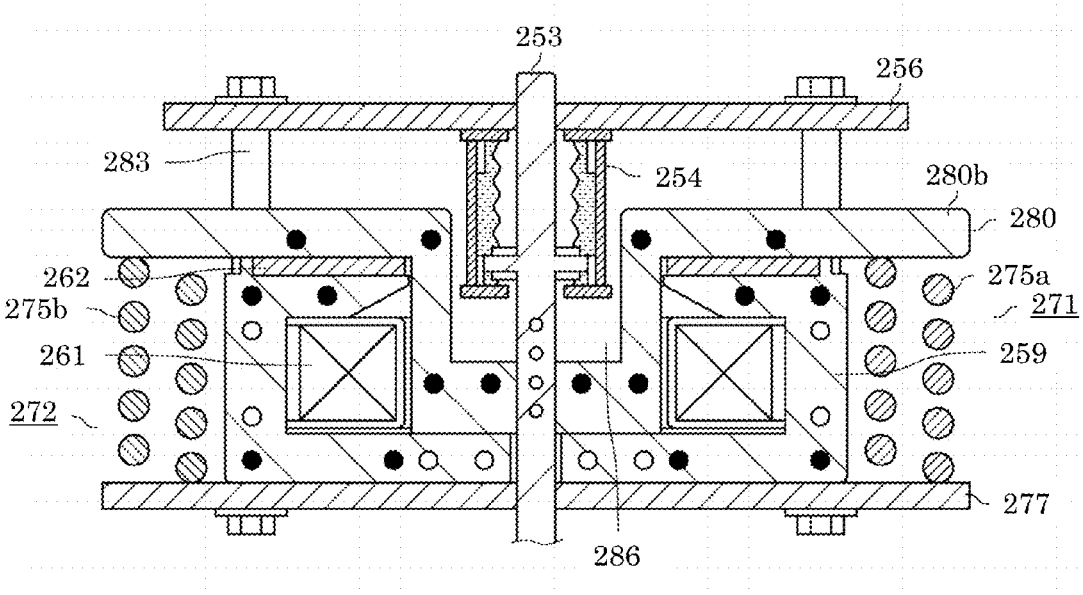
FIG. 18 is a configuration view according to an electromagnet device of Embodiment 9 of the present invention.

In FIG. 18, the same reference numerals are given to those identical or equivalent to portions in FIG. 17.

An electromagnet portion 272 has: a fixed core 259; a movable core 280 arranged in face-to-face relation to the fixed core 259; and a driving shaft 273 which is provided by passing through a central portion of the movable core 280 and is fixed to the movable core 280. Furthermore, the electromagnet portion 272 has: an electromagnetic coil 261 which is provided on the fixed core 259 and generates a magnetic field by energization; and a permanent magnet 262 provided on the fixed core 259 side. Further, the electromagnet portion 272 has: braces 283 that fix the fixed core 259; and an upper plate 256 serving as an open-contact side plate and a lower plate 257 serving as a close-contact side plate, which are arranged on both ends of the braces 283.

Open-contact springs 275*a*, 275*b* (biasing body) are provided between the lower surface of a branch portion 280*b* of the movable core 280 and the lower plate 277. The open-contact springs 275*a*, 275*b* are each a compressed coil spring and generate elastic repulsive force in the axial direction between the branch portion 280*b* of the movable core 280 and the lower plate 277.

The placing position of a cushioning device 254 is similar to that of Embodiment 8.

A concave portion 286 surrounding the driving shaft 273 is provided on an upper portion of the movable core 280. The cushioning device 254 is fixed to the lower surface of the upper plate 256 serving as the open-contact side plate. When the movable core 280 is displaced from an open-contact side position (backward movement position) to a close-contact side position (forward movement position) or is displaced from the close-contact side position (forward movement position) to the open-contact side position (backward movement position), the cushioning device 254 is displaced inside the concave portion 286 of the movable core 280.

As compared to Embodiment 8, the open-contact spring moves from the upper portion of the upper plate to between the branch portion of the movable core and the lower plate; and therefore, the length of the driving shaft is shortened in the upper portion of the upper plate. As described above, the length of the driving shaft portion can be shortened; and therefore, the entire length of the electromagnet device can be further shortened (an effect exists).

As described above, the electromagnet device according to Embodiment 9 is structured such that the open-contact spring is provided between the branch portion of the movable core and the lower plate. Therefore, effects similar to that of the electromagnet device of Embodiment 8 are exhibited and there has an effect that the entire length of the electromagnet device can be further shortened.

Embodiment 10

Embodiment 10 relates to an electromagnet device which is configured such that a cushioning device is provided in a fixed core.

Hereinafter, the configuration and the operation of Embodiment 10 of the present invention will be described centering on differences from Embodiment 6 with reference to FIG. 19 serving as a configuration view of an electromagnet device 501.

An electromagnet portion 502 has: a fixed core 509; a movable core 510 arranged in face-to-face relation to the fixed core 509; and a driving shaft 503 which is provided by passing through a central portion of the movable core 510 and is fixed to the movable core 510. Furthermore, the electromagnet portion 502 has: an electromagnetic coil 511 which is provided on the fixed core 509 and generates a magnetic field by energization; and a permanent magnet 512 provided on the fixed core 509 side. Further, the electromagnet portion 502 has: braces 513 that fix the fixed core 509; and an upper plate 506 serving as an open-contact side plate and a lower plate 507 serving as a close-contact side plate, which are arranged on both ends of the braces 513.

A spring receiver 508 is fixed on the leading end side of the driving shaft 503 protruded to the outside from the upper plate 506. An open-contact spring 505 (biasing body) is inserted onto a shaft portion of the driving shaft 503 between the upper plate 506 and the spring receiver 508. The open-contact spring 505 is a compressed coil spring and generates elastic repulsive force in the axial direction between the upper plate 506 and the spring receiver 508.

A cushioning device 504 is provided in the inside of the fixed core 509 and is fixed on the lower plate 507. Incidentally, the structure of the cushioning device 504 is the same as that of the cushioning device 204 of Embodiment 6.

Figure 19:
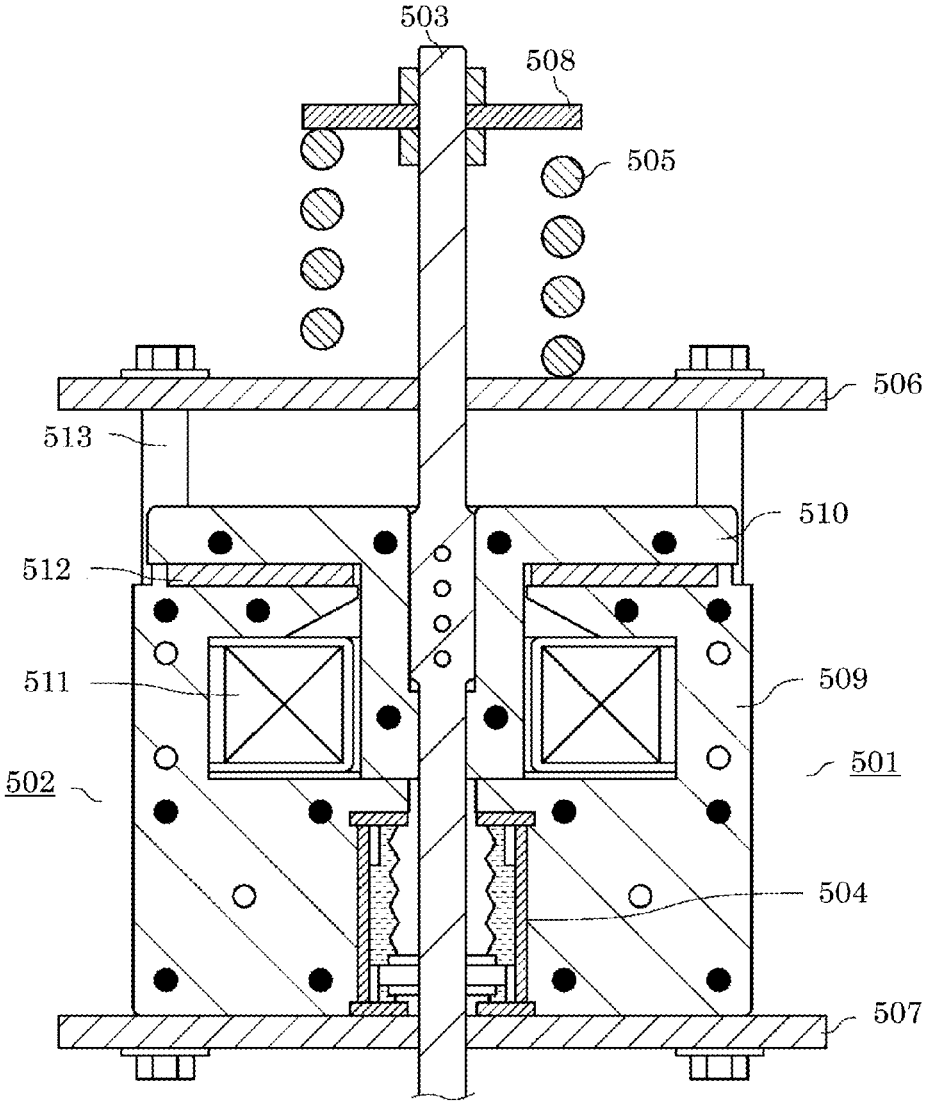
FIG. 19 is a configuration view according to an electromagnet device of Embodiment 10 of the present invention.

In the case of having a margin in the fixed core portion, for example, in the case of increasing the suction force of the permanent magnet at the close-contact side position (forward movement position) by increasing the amount of the magnetic substance of the fixed core, the entire length of the electromagnet device can be shortened by arranging the cushioning device as shown in FIG. 19.

As described above, the electromagnet device according to Embodiment 10 is configured such that the cushioning device is provided in the fixed core. Therefore, the electromagnet device can be provided with the cushioning device which reduces impacts during the completion of the close-contact and the open-contact operation and there has an effect that the entire device can be reduced in size.

Embodiment 11

Embodiment 11 relates to an electromagnet device which is configured such that a cushioning device is separated from a driving shaft of an electromagnet portion, a plurality of cushioning devices are placed on the upper surface of an upper plate, and driving shafts of the cushioning devices are coupled to a movable core.

Hereinafter, the configuration and the operation of Embodiment 11 of the present invention will be described centering on differences from Embodiment 6 with reference to FIG. 20 serving as a configuration view of an electromagnet device 611.

An electromagnet portion 612 has: a fixed core 619; a movable core 620 arranged in face-to-face relation to the fixed core 619; and a driving shaft 613 which is provided by passing through a central portion of the movable core 620 and is fixed to the movable core 620. Furthermore, the electromagnet portion 612 has: an electromagnetic coil 621 which is provided on the fixed core 619 and generates a magnetic field by energization; and a permanent magnet 622 provided on the fixed core 619 side. Further, the electromagnet portion 612 has: braces 623 that fix the fixed core 619; and an upper plate 616 serving as an open-contact side plate and a lower plate 617 serving as a close-contact side plate, which are arranged on both ends of the braces 623.

A spring receiver 618 is fixed on the leading end side of the driving shaft 613 protruded to the outside from the upper plate 616. An open-contact spring 615 (biasing body) is inserted onto a shaft portion of the driving shaft 613 between the upper plate 616 and the spring receiver 618. The open-contact spring 615 is a compressed coil spring and generates elastic repulsive force in the axial direction between the upper plate 616 and the spring receiver 618.

A plurality of cushioning devices 631, 632 are fixed to the upper surface of the upper plate 616. Driving shafts of the cushioning devices (hereinafter, described as "cushioning device driving shafts") of the cushioning devices 631, 632 are coupled to branch portions of the movable core 620 of the electromagnet portion 612.

The operation of the cushioning devices 631, 632 will be described. The structure and the operation of the cushioning devices 631, 632 are basically similar to that of the cushioning device 204 of Embodiment 6. However, a different point is that the cushioning device driving shaft 633 of the cushioning device 631 and the cushioning device driving shaft 634 of the cushioning device 632 are each coupled to each of the branch portions of the movable core 620.

First, the movable core 620 is at an open-contact side position (backward movement position). At this time, a cushioning body portion 631*b* of the cushioning device 631 is fitted into an upper cushioning chamber 631*d*; and a cushioning body portion 632*b* of the cushioning device 632 is fitted into an upper cushioning chamber 632*d*.

When energization is performed from a control board to the electromagnetic coil 621, the movable core 620 is suctioned to the fixed core 619 and is displaced from the open-contact side position (backward movement position) toward a close-contact side position (forward movement position) against a load of the open-contact spring 615. At this time, the cushioning device driving shaft 633 of the cushioning device 631 is displaced toward a lower cushioning chambers 631*e*; and the cushioning device driving shaft 634 of the cushioning device 632 is displaced toward a lower cushioning chamber 632*e*.

When the movable core 620 reaches the close-contact side position (forward movement position), the cushioning body portion 631*b* of the cushioning device 631 is fitted into the lower cushioning chamber 631*e* and the cushioning body portion 632*b* of the cushioning device 632 is fitted into the lower cushioning chamber 632*e*.

Figure 20:
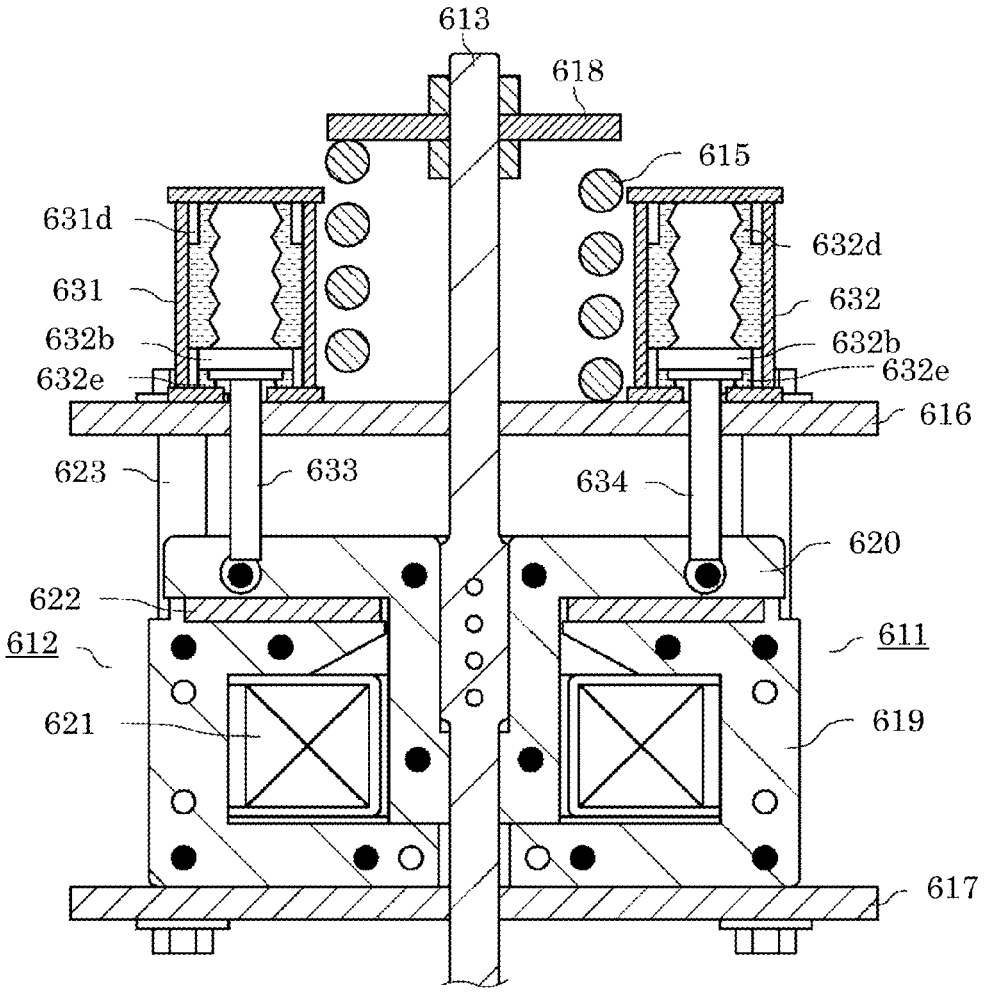
FIG. 20 is a configuration view according to an electromagnet device of Embodiment 11 of the present invention.

FIG. 20 represents a state where the movable core 620 is at the close-contact side position (forward movement position), the cushioning body portion 631*b* of the cushioning device 631 coupled to the movable core 620 is fitted into the lower cushioning chamber 631*e*, and the cushioning body portion 632*b* of the cushioning device 632 coupled to the movable core 620 is fitted into the lower cushioning chamber 632*e*.

In FIG. 20, two cushioning devices are placed; however, three or more cushioning devices can be provided. In the case where a plurality of cushioning devices are arranged in axial symmetry; for example, three cushioning devices are provided, the cushioning devices are preferable to be placed at 120 degree intervals.

A plurality of the cushioning devices 631, 632 are fixed to the upper surface of the upper plate 616; and thus, the plurality of the cushioning devices 631, 632 can be arranged in a range smaller than the height of the open-contact spring 615 and therefore the entire length of the electromagnet device can be shortened as in Embodiment 6.

Furthermore, in the case of exchanging the cushioning devices 631, 632, the open-contact spring 615 does not need to be removed and maintainability is improved.

As described above, the electromagnet device according to Embodiment 11 is configured such that the cushioning device is separated from the driving shaft of the electromagnet portion, the plurality of the cushioning devices are placed on the upper surface of the upper plate, and the cushioning device driving shafts are coupled to the movable core. Therefore, the electromagnet device can be provided with the cushioning devices which reduce impacts during the completion of the close-contact and the open-contact operation and there has an effect that the entire device can be reduced in size. Further, maintainability during replacement of the cushioning devices can be improved.

Incidentally, the present invention can freely combine the respective embodiments and appropriately change and/or omit the respective embodiments, within the scope of the present invention.

The invention claimed is:

1. An electromagnetic operating device comprising:

a fixed core;

a movable core movably configured with respect to said fixed core;

an electromagnetic coil which moves said movable core by excitation to open or close a switch device coupled to said movable core; and a driving power supply that supplies electric power to said electromagnetic coil, wherein said driving power supply is composed of: a capacitor power supply which performs opening/closing operation of said switch device in a normal time, and has a capacitor that stores electric power to be supplied to said electromagnetic coil and a control board that controls a current to be supplied from said capacitor to said electromagnetic coil in response to an open-contact or close-contact command to said switch device; and a DC power supply which performs opening/closing operation of said switch device in an emergency at which said capacitor power supply does not operate and directly supplies DC electric power to said electromagnetic coil, wherein said electromagnetic operating device includes switching means which switches between a circuit to be connected from said capacitor power supply to said electromagnetic coil and a circuit to be connected from said DC power supply to said electromagnetic coil, and wherein said switching means is attachably and detachably connected by a connecting means inserted in the middle of the circuit to be connected from said capacitor power supply to said electromagnetic coil, and switches from the circuit on the capacitor power supply side to the circuit on the DC power supply side in the emergency at which said capacitor power supply does not operate.

2. The electromagnetic operating device according to claim 1, wherein said switching means has: a first relay which is provided in the middle of the circuit to be connected from said capacitor power supply to said electromagnetic coil and is operated by an external command; and a second relay which is provided in the circuit to be connected from said DC power supply to said electromagnetic coil and is operated by the external command.

3. The electromagnetic operating device according to claim 2, wherein said first relay has a normally closed contact in which said first relay is ON during energization of an operation coil and is OFF during non-energization thereof, and said capacitor power supply and said electromagnetic coil are connected via the normally closed contact of said first relay.

4. The electromagnetic operating device according to claim 3, wherein said first relay has a normally open contact in addition to the normally closed contact;

said second relay has a normally open contact; and the normally open contact of said first relay is connected to said operation coil of said second relay, and wherein when said operation coil of said first relay is energized by the external command, the normally closed contact of said first relay is opened; the normally open contact of said first relay is closed; and the normally open contact of said second relay is further closed, hereby supply of electric power to said electromagnetic coil is switched from said capacitor power supply to said DC power supply.

5. The electromagnetic operating device according to claim 4, further comprising a resistor inserted in the middle of the circuit in which said DC power supply is connected to said electromagnetic coil.

6. The electromagnetic operating device according to claim 5, wherein said resistor is adjusted to be a resistance value at which a current flowing in the circuit to be connected from said DC power supply to said electromagnetic coil is set to be equal to or lower than 5 A.

7. The electromagnetic operating device according to claim 3, further comprising a resistor inserted in the middle of the circuit in which said DC power supply is connected to said electromagnetic coil.

8. The electromagnetic operating device according to claim 7, wherein said resistor is adjusted to be a resistance value at which a current flowing in the circuit to be connected from said DC power supply to said electromagnetic coil is set to be equal to or lower than 5 A.

9. The electromagnetic operating device according to claim 2, further comprising a resistor inserted in the middle of the circuit in which said DC power supply is connected to said electromagnetic coil.

10. The electromagnetic operating device according to claim 9, wherein said resistor is adjusted to be a resistance value at which a current flowing in the circuit to be connected from said DC power supply to said electromagnetic coil is set to be equal to or lower than 5 A.

11. The electromagnetic operating device according to claim 1, further comprising a resistor inserted in the middle of the circuit in which said DC power supply is connected to said electromagnetic coil.

12. The electromagnetic operating device according to claim 11, wherein said resistor is adjusted to be a resistance value at which a current flowing in the circuit to be connected from said DC power supply to said electromagnetic coil is set to be equal to or lower than 5 A.

13. The electromagnetic operating device according to claim 1, wherein the capacitor is disconnected from the DC power supply via the switching means.

14. The electromagnetic operating device according to claim 1, wherein during normal time, the capacitor is connected to the electromagnetic coil and the DC power supply is disconnected from the electromagnetic coil, and wherein during the emergency, the capacitor is disconnected from the electromagnetic coil and the DC power supply is connected to the electromagnetic coil.

* * * * *